US006533917B1

(12) United States Patent
Nishino et al.

(10) Patent No.: US 6,533,917 B1
(45) Date of Patent: Mar. 18, 2003

(54) METHOD FOR PRODUCING ALUMINUM SUPPORT FOR LITHOGRAPHIC PRINTING PLATE

(75) Inventors: Atsuo Nishino, Shizuoka (JP); Yoshitaka Masuda, Shizuoka (JP); Akio Uesugi, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/556,823

(22) Filed: Apr. 21, 2000

(30) Foreign Application Priority Data

| | | |
|---|---|---|
| Apr. 22, 1999 | (JP) | 11-115112 |
| Apr. 27, 1999 | (JP) | 11-120452 |
| Jun. 24, 1999 | (JP) | 11-178624 |
| Jun. 24, 1999 | (JP) | 11-178625 |

(51) Int. Cl.[7] ..... C25D 5/34; C25D 11/16; C25D 5/48; C25D 11/04

(52) U.S. Cl. ..... 205/206; 205/208; 205/209; 205/213; 205/214; 205/219; 205/220; 205/324

(58) Field of Search ..... 205/206, 208, 205/209, 213, 214, 219, 324, 220

(56) References Cited

U.S. PATENT DOCUMENTS

| | | | | |
|---|---|---|---|---|
| 3,935,080 A | | 1/1976 | Gumbinner et al. | 24/28 |
| 4,482,444 A | * | 11/1984 | Frass et al. | 204/129.35 |
| 4,676,879 A | | 6/1987 | Salvadori | 204/129.75 |
| 4,786,381 A | | 11/1988 | Mohr et al. | 204/129.75 |
| 4,872,946 A | | 10/1989 | Uesugi et al. | 156/637 |
| 5,041,198 A | | 8/1991 | Hausmann | 204/129.35 |
| 5,860,184 A | * | 1/1999 | Platzer et al. | 15/179 |

FOREIGN PATENT DOCUMENTS

| | | | | |
|---|---|---|---|---|
| EP | 0 422 682 A2 | | 4/1991 | |
| EP | 0 645 260 A1 | | 3/1995 | |
| EP | 0 816 118 A1 | | 1/1998 | |
| EP | 0 874 068 A1 | | 10/1998 | |
| EP | 0 960 743 A2 | | 1/1999 | |
| JP | 56-015396 A | * | 2/1981 | |
| JP | 57-46436 B2 | * | 10/1992 | |
| JP | 08-258440 A | * | 10/1996 | |
| JP | 9-109570 | | 4/1997 | ..... B41N/3/03 |
| JP | 09-109570 A | * | 4/1997 | |

OTHER PUBLICATIONS

* References N and O were cited on the International Search Report.*
Search Report.
Patent Abstracts of Japan (08258440) Oct. 8, 1996.
Patent Abstracts of Japan (56015396) Feb. 14, 1981.
European Search Report dated Jul. 30, 2001.
English Language Abstract 09–109570 Apr. 28, 1997.

* cited by examiner

*Primary Examiner*—Edna Wong
(74) *Attorney, Agent, or Firm*—Sughrue Mion, PLLC

(57) ABSTRACT

Disclosed are a method for producing an aluminum support for lithographic printing plates, comprising subjecting an aluminum plate in sequence to (1) a surface roughening treatment, (2) a heat treatment, (3) a treatment of dissolving from 0.01 to 5 g/m$^2$ of said aluminum plate, and then (4) an anodization treatment; a method for producing an aluminum support for lithographic printing plates, comprising subjecting an aluminum plate to an electrochemical surface roughening treatment both before and after an electrolytic treatment in an aqueous neutral salt solution using the aluminum plate as a cathode.

14 Claims, 6 Drawing Sheets

METHOD FOR PRODUCING ALUMINUM SUPPORT FOR LITHOGRAPHIC PRINTING PLATE

FIELD OF THE INVENTION

The present invention relates to a method for producing an aluminum support which is used as a support for lithographic printing plates.

The present invention also relates to a method for producing an aluminum support, including surface roughening of an aluminum support which is used as a support for lithographic printing plates, more specifically, the present invention relates to a method suitable for the surface roughening of an aluminum plate prone to generation of rush mat-like wrinkles called streaks ascribable to the difference in the orientation of crystal grains or generation of granular treatment unevenness called plane quality unevenness, which are readily occur in conventional chemical etching treatments.

Furthermore, the present invention relates to a method for producing an aluminum support for lithographic printing plates, which can attain uniform surface roughening of an aluminum plate containing many impurities and having bad graining property.

BACKGROUND OF THE INVENTION

The surface roughening of an aluminum support for lithographic printing plates is generally performed by an AC etching method where an ordinary sinusoidal AC current or a special alternating waveform current such as rectangular waveform current is used. Using a suitable electrode such as graphite as a counter electrode, the surface roughening of the aluminum plate is usually performed by a single treatment. However, the depth of pits obtained is generally shallow and the resulting aluminum support has a short press life. Therefore, various methods have been heretofore proposed so as to obtain an aluminum plate having a grained surface suitable for printing plates, where pits having a depth larger than the diameter thereof are uniformly and densely present. Known examples of these methods include a surface roughening method using a special electrolytic power source waveform (see, JP-A-53-67507 (the term "JP-A" as used herein means an "unexamined published Japanese patent application")), a ratio between the quantity of electricity at an anode time and the quantity of electricity at a cathode time in an electrolytic surface roughening using AC (see, JP-A-54-65607), a power source waveform (see, JP-A-56-25381), a combination with the quantity of current passed per the unit area (see, JP-A-56-29699).

On the other hand, with respect to the method for producing an aluminum support, an aluminum support prepared as follows has been used as a support for lithographic printing plates. An aluminum ingot melted and held is cast into a slab (thickness: from 400 to 600 mm, width: from 1,000 to 2,000 mm, length: from 2,000 to 6,000 mm). The slab obtained is subjected to a surface-cutting step where an impurity structure portion on the slab surface is cut off by from 3 to 10 mm using a surface cutting machine and then to a soaking treatment step where the slab is kept in a soaking pit at a temperature of from 480 to 540° C. for from 6 to 12 hours so as to remove stress inside the slab and make the structure uniform. Thereafter, the slab is hot-rolled at a temperature of from 480 to 540° C. into a thickness of from 5 to 40 mm and then cold-rolled at room temperature into a predetermined thickness. Furthermore, in order to have a uniform structure, the slab is annealed, thereby homogenizing the rolled structure. The thus-treated slab is then subjected to cold rolling into a predetermined thickness and corrected to obtain a plate having good flatness.

From the standpoint of energy savings and effective use of resources, it is demanded to use, as an aluminum support for lithographic printing plates, a general-purpose aluminum plate or an aluminum plate prepared by omitting the intermediate annealing treatment or soaking treatment from the production process of the aluminum plate.

However, when an aluminum support for lithographic printing plates is prepared using the above-described aluminum plate, streaking or treatment unevenness called plane quality unevenness is readily generated. This is considered to occur because the aluminum dissolving rate varies depending on the crystal orientation in the progress of a chemical dissolution reaction or the reaction of aluminum varies depending on the crystal orientation in the progress of electrochemical pitting reaction.

In other words, irregularities formed due to the difference in the dissolving rate in a chemical dissolution reaction or variations in the pitting reaction (e.g., number of pits, difference in the size) depending on the crystal orientation are viewed as streaking or plane quality unevenness.

SUMMARY OF THE INVENTION

The present invention relates to a method for producing an aluminum support for lithographic printing plates, which is free from generation of failures called streaking or plane quality unevenness, and also relates to a method for producing an aluminum support for lithographic printing plates, which is improved in the surface shape.

Furthermore, the present invention relates to a method for producing an aluminum support for lithographic printing plates, which has a surface shape free from generation of failures called streaking or plane quality unevenness.

Still further, the present invention relates to a method for surface roughening a lithographic printing plate aluminum support having an improved surface shape free from generation of failures called streaking or plane quality unevenness, and also relates to a method for producing an aluminum support for lithographic printing plates.

As a result of extensive investigations, the present inventors have found that when an aluminum plate subjected to an electrochemical surface roughening treatment, which is in a state such that smuts mainly comprising aluminum hydroxide are formed on the surface, is heat treated, streaking is difficult to occur in the afterward etching treatment.

Furthermore, the present inventors have found that when an aluminum plate is preliminarily surface-roughened in an aqueous hydrochloric acid solution before an electrochemical surface roughening treatment in an aqueous nitric acid solution, uniform honeycomb pits are formed. The present inventors have also found that when an electrochemical surface treatment in an aqueous hydrochloric acid solution is performed after an electrochemical surface roughening treatment in an aqueous nitric acid solution, an aluminum support for lithographic printing plates, having excellent printing capability can be obtained. The present inventors have also found that although an auxiliary anode is used in an electrochemical surface roughening treatment using AC so as to prevent the main electrode from dissolving, when an aqueous neutral salt solution is used as an electrolytic solution in the moiety using the auxiliary anode, dissolving of the aluminum plate takes place and the treatment steps can be reduced as compared with conventional systems involving chemical etching.

Still further, the present inventors have found that when an aluminum plate is subjected to a preliminary surface roughening treatment with an electricity quantity of from 1 to 300 C/dm$^2$ using AC having a frequency of from 50 to 500 Hz and then subjected to an electrochemical surface treatment, streaking is difficult to occur in the afterward etching treatment.

Still further, the present inventors have found that when an aluminum plate is subjected to a preliminary surface roughening treatment with an electricity quantity of from 1 to 300 C/dm$^2$ using AC having a frequency of from 50 to 500 Hz and then subjected to a desmutting treatment and further to an electrochemical surface roughening treatment, streaking is difficult to occur in the afterward etching treatment. The present inventors have also found that in a method where an aluminum support is preliminarily subjected to an electrochemical surface roughening treatment in an aqueous solution mainly comprising hydrochloric acid and then to a desmutting treatment in an acidic aqueous solution, when the desmutting treatment is performed while treating the aluminum plate by cathodic electrolysis using an auxiliary electrode cell of an electrochemical surface roughening apparatus, the desmutting treatment can be performed with good efficiency. The present invention has been accomplished based on these findings.

The practical embodiments of the method for producing an aluminum support for lithographic printing plates of the present invention are described in detail below.

Embodiment 1:

An aluminum plate is subjected to (1) a surface roughening treatment, (2) a heat treatment, (3) a treatment of dissolving from 0.01 to 5 g/m$^2$ of the aluminum plate, and then (4) an anodization treatment, whereby streaking is difficultly generated in the treatment of dissolving from 0.01 to 5 g/m$^2$ of the aluminum plate performed before the anodization treatment.

The above-described surface roughening treatment is performed by combining one or more of a mechanical surface roughening treatment, a buffing treatment, a polishing treatment, a chemical etching treatment in an aqueous acid or alkali solution, an electropolishing treatment in an aqueous acid or alkali solution using the aluminum plate as an anode, an electrolytic treatment in an aqueous neutral salt solution using the aluminum plate as an anode or a cathode, and an electrochemical surface roughening treatment in an acidic aqueous solution using DC or AC.

Embodiment 2:

An aluminum plate is subjected to (1) a chemical etching treatment, (2) an electrochemical surface roughening treatment in an acidic aqueous solution, (3) a heat treatment, (4) a treatment of etching of from 0.01 to 5 g/m$^2$ of the aluminum plate, and then (5) an anodization treatment, whereby streaking is difficultly generated in the treatment of dissolving from 0.01 to 5 g/m$^2$ of the aluminum plate performed before the anodization treatment.

Embodiment 3:

An aluminum plate is subjected to (1) a chemical etching treatment, (2) a preliminary electrochemical surface roughening treatment in an aqueous hydrochloric acid solution with an electricity quantity of from 1 to 300 C/dm$^2$, (3) a treatment of etching from 0.01 to 3 g/m$^2$ of the aluminum plate, (4) an electrochemical surface roughening treatment in an acidic aqueous solution, (5) a heat treatment, (6) a treatment of etching from 0.01 to 5 g/m$^2$ of the aluminum plate, and then (7) an anodization treatment, whereby streaking is difficultly generated in the treatment of dissolving from 0.01 to 5 g/m$^2$ of the aluminum plate performed before the anodization treatment. Furthermore, by performing a preliminary electrochemical surface roughening treatment in an aqueous hydrochloric acid solution with an electricity quantity of from 1 to 300 C/dm$^2$ before the electrochemical surface roughening treatment in an acidic aqueous solution, uniform pits can be formed in the acidic aqueous solution and also difficult viewing of streaks and improved printing capability can be attained.

Embodiment 4:

An aluminum plate is subjected to (1) a chemical etching treatment, (2) an electrochemical surface roughening treatment in an acidic aqueous solution, (3) a treatment of etching from 0.01 to 5 g/m$^2$ of the aluminum plate, (4) an electrochemical surface roughening treatment in an aqueous hydrochloric acid solution with an electricity quantity of from 1 to 300 C/dm$^2$, (5) a heat treatment, (6) a treatment of etching from 0.01 to 3 g/m$^2$ of the aluminum plate, and then (7) an anodization treatment, whereby streaking is difficultly generated in the treatment of dissolving from 0.01 to 5 g/m$^2$ of the aluminum plate performed before the anodization treatment. Furthermore, by performing an electrochemical surface roughening treatment in an aqueous hydrochloric acid solution with an electricity quantity of from 1 to 300 C/dm$^2$ after the electrochemical surface roughening treatment in an acidic aqueous solution, difficult viewing of streaks and improved printing capability can be attained.

In Embodiments 1 to 4, 1) the heat treatment is preferably performed to raise the aluminum plate temperature to from 70 to 700° C., 2) the treatment of etching from 0.01 to 5 g/m$^2$ of the aluminum plate is preferably a chemical etching treatment in an aqueous acid or alkali solution, an electropolishing treatment in an aqueous acid or alkali solution using the aluminum plate as an anode or an electrolytic treatment in an aqueous neutral salt solution using the aluminum plate as a cathode, 3) after the etching with an alkaline aqueous solution, after the electropolishing treatment in an aqueous alkali solution or after the electrolytic treatment in an aqueous neutral salt solution using the aluminum plate as a cathode, the aluminum plate is preferably desmutted in an acidic aqueous solution, and 4) before the first-step chemical etching treatment, a mechanical surface roughening treatment, a buffing treatment, or both a buffing treatment and a mechanical surface roughening treatment is(are) preferably performed; before the anodization treatment, a polishing treatment is preferably performed; and after the anodization treatment, a hydrophilization treatment is preferably performed.

The practical embodiments of the surface roughening method of electrochemically surface roughening an aluminum plate both before and after an electrolytic treatment in an aqueous neutral salt solution using the aluminum plate as a cathode, of the present invention are described in detail below.

Embodiment 5:

An aluminum plate is subjected in sequence to (1) an electrochemical surface roughening treatment both before and after an electrolytic treatment in an aqueous neutral salt solution using the aluminum plate as a cathode, (2) a treatment of dissolving from 0.01 to 5 g/m$^2$ of the aluminum plate, and then (3) an anodization treatment.

Embodiment 6:

An aluminum plate is subjected in sequence to (1) a chemical etching treatment, (2) a preliminary electrochemical surface roughening treatment in an aqueous hydrochloric acid solution with an electricity quantity of from 1 to 300 C/dm$^2$, (3) an electrolytic treatment in an aqueous neutral salt solution using the aluminum plate as a cathode, (4) an electrochemical surface roughening treatment in an acidic aqueous solution, (5) a treatment of etching from 0.01 to 5 g/m$^2$ of the aluminum plate, and then (6) an anodization treatment.

Embodiment 7:

An aluminum plate is subjected in sequence to (1) a chemical etching treatment, (2) an electrochemical surface roughening treatment in an acidic aqueous solution, (3) a treatment of etching from 0.01 to 5 g/m$^2$ of the aluminum plate, (4) an electrochemical surface roughening treatment in an aqueous hydrochloric acid solution with an electricity quantity of from 1 to 300 C/dm$^2$, (5) an electrolytic treatment in an aqueous neutral salt solution using the aluminum plate as a cathode, (6) a treatment of etching from 0.01 to 5 g/m$^2$ of the aluminum plate, and then (7) an anodization treatment.

Embodiment 8:

An aluminum plate is subjected in sequence to (1) an electrochemical surface roughening treatment both before and after an electrolytic treatment in an aqueous neutral salt solution using the aluminum plate as a cathode, (2) a heat treatment, (3) a treatment of dissolving from 0.01 to 5 g/m$^2$ of the aluminum plate, and then (4) an anodization treatment.

In Embodiments 5 to 8, 1) the treatment of etching from 0.01 to 5 g/m$^2$ of the aluminum plate is preferably a chemical etching treatment in an aqueous acid or alkali solution, an electropolishing treatment in an aqueous acid or alkali solution using the aluminum plate as an anode or an electrolytic treatment in an aqueous neutral salt solution using the aluminum plate as a cathode, 2) after the etching with an alkaline aqueous solution, after the electropolishing treatment in an aqueous alkali solution or after the electrolytic treatment in an aqueous neutral salt solution using the aluminum plate as a cathode, the aluminum plate is preferably desmutted in an acidic aqueous solution, 3) before the first-step chemical etching treatment, a mechanical surface roughening treatment or both a buffing treatment and a mechanical surface roughening treatment is(are) preferably performed; before the first-step chemical etching treatment, a buffing is preferably performed; before the anodization treatment, a polishing treatment is preferably performed; and after the anodization treatment, a hydrophilization treatment is preferably performed, and 4) the heat treatment is preferably performed to raise the aluminum plate temperature to from 70 to 700° C.

The practical embodiments of the present invention are also described in detail below.

Embodiment 9:

A method for producing an aluminum plate for lithographic printing plates, comprising subjecting an aluminum plate in sequence to (1) an etching treatment and/or a desmutting treatment in an acidic aqueous solution, (2) a preliminary electrochemical surface roughening treatment in an aqueous hydrochloric acid solution with an electricity quantity of from 1 to 300 C/dm$^2$ using AC of from 50 to 500 Hz, (3) an electrochemical surface roughening treatment in an acidic aqueous solution, (4) a treatment of etching from 0.01 to 5 g/m$^2$ of the aluminum plate and/or a desmutting treatment in an acidic aqueous solution, and then (5) an anodization treatment.

Embodiment 10:

A method for producing an aluminum plate for lithographic printing plates, comprising subjecting an aluminum plate in sequence to (1) an etching treatment and/or a desmutting treatment in an acidic aqueous solution, (2) a preliminary electrochemical surface roughening treatment in an aqueous hydrochloric acid solution with an electricity quantity of from 1 to 300 C/dm$^2$ using AC of from 50 to 500 Hz, (3) an electrochemical surface roughening treatment in an acidic aqueous solution, (4) a heat treatment, (5) a treatment of etching from 0.01 to 5 g/m$^2$ of the aluminum plate and/or a desmutting treatment in an acidic aqueous solution, and then (6) an anodization treatment.

Embodiment 11:

A method for producing an aluminum plate for lithographic printing plates, comprising subjecting an aluminum plate in sequence to (1) an etching treatment and/or a desmutting treatment in an acidic aqueous solution, (2) a preliminary electrochemical surface roughening treatment in an aqueous hydrochloric acid solution with an electricity quantity of from 1 to 300 C/dm$^2$ using AC of from 50 to 500 Hz, (3) a treatment of etching from 0.01 to 5 g/m$^2$ of the aluminum plate and/or a desmutting treatment in an acidic aqueous solution, (4) an electrochemical surface roughening treatment in an acidic aqueous solution, (5) a treatment of etching from 0.01 to 5 g/m$^2$ of the aluminum plate and/or a desmutting treatment in an acidic aqueous solution, and then (6) an anodization treatment.

Embodiment 12:

A method for producing an aluminum plate for lithographic printing plates, comprising subjecting an aluminum plate in sequence to (1) an etching treatment and/or a desmutting treatment in an acidic aqueous solution, (2) a preliminary electrochemical surface roughening treatment in an aqueous hydrochloric acid solution with an electricity quantity of from 1 to 300 C/dm$^2$ using AC of from 50 to 500 Hz, (3) a treatment of etching from 0.01 to 5 g/m$^2$ of the aluminum plate and/or a desmutting treatment in an acidic aqueous solution, (4) an electrochemical surface roughening treatment in an acidic aqueous solution, (5) a heat treatment, (6) a treatment of etching from 0.01 to 5 g/m$^2$ of the aluminum plate and/or a desmutting treatment in an acidic aqueous solution, and then (7) an anodization treatment.

In Embodiments 9 to 12 of the present invention, a mechanical surface roughening treatment, a buffing treatment or both a buffing treatment and a mechanical surface roughening treatment is(are) performed before the first-step chemical etching treatment, so that a more suitable aluminum support for lithographic printing plates can be obtained.

The heat treatment is preferably performed to raise the aluminum plate temperature to from 70 to 700° C.

In Embodiments 9 to 12 of the present invention, the treatment of etching from 0.01 to 5 g/m$^2$ of the aluminum plate is a chemical etching treatment in an aqueous acid or alkali solution, an electropolishing treatment in an aqueous acid or alkali solution using the aluminum plate as an anode, an electrolytic treatment in an aqueous neutral salt solution using the aluminum plate as a cathode or an etching treatment comprising two or more of these treatments.

When a polishing treatment is performed before the anodization treatment, a more suitable aluminum support for lithographic printing plates can be obtained.

Furthermore, after the anodization treatment, a hydrophilization treatment is preferably performed.

Embodiment 13 of the present invention is a method for surface roughening an aluminum support for lithographic printing plates, comprising performing a preliminary electrochemical surface roughening treatment in an aqueous solution mainly comprising hydrochloric acid and then performing a desmutting treatment in an acidic aqueous solution, wherein the desmutting treatment is performed while treating the aluminum plate by cathodic electrolysis using an auxiliary electrode cell of an electrochemical surface roughening apparatus.

Embodiment 14 of the present invention is a method for surface roughening an aluminum support for lithographic printing plates, comprising subjecting an aluminum plate in sequence to (1) an etching treatment and/or a desmutting treatment in an acidic aqueous solution, (2) a preliminary electrochemical surface roughening in an aqueous hydrochloric acid solution with an electricity quantity of from 1 to 300 C/dm$^2$ using AC having a frequency of from 50 to 500 Hz, (3) a desmutting treatment while treating the aluminum plate by cathodic electrolysis in an acidic aqueous solution, (4) an electrochemical surface roughening treatment in an acidic aqueous solution, (5) a treatment of etching from 0.01 to 5 g/m$^2$ of the aluminum plate and/or a desmutting treatment in an acidic aqueous solution, and then (6) an anodization treatment.

In Embodiments 13 and 14 of the present invention, which is a method of performing a desmutting treatment in an acidic aqueous solution after the preliminary electrochemical surface roughening in an aqueous solution mainly comprising hydrochloric acid, the desmutting treatment is preferably performed while treating the aluminum plate by cathodic electrolysis using an auxiliary electrode cell of an electrochemical surface roughening apparatus.

Furthermore, in Embodiments 13 and 14 of the present invention, the solution for use in the desmutting treatment is preferably an aqueous solution mainly comprising hydrochloric acid, sulfuric acid or nitric acid, or a mixed solution thereof.

Still further, in Embodiments 13 and 14 of the present invention, the electrochemical surface roughening in an acidic aqueous solution is preferably performed with an electricity quantity of from 1 to 800 C/dm$^2$.

Still further, in Embodiments 13 and 14 of the present invention, when a mechanical surface roughening treatment, a buffing treatment and a combination of buffing and mechanical treatments is performed before the first-step chemical etching treatment, a more suitable aluminum support for lithographic printing plates can be obtained.

Still further, in Embodiments 13 and 14 of the present invention, the heat treatment is preferably performed to raise the aluminum plate temperature to from 70 to 700° C.

Embodiments 13 and 14 of the method of the present invention are described in detail below.

In the method of the present invention, the treatment of etching from 0.01 to 5 g/m$^2$ of the aluminum plate is a chemical etching treatment in an aqueous acid or alkali solution, an electropolishing treatment in an aqueous acid or alkali solution using the aluminum plate as an anode, an electrolytic treatment in an aqueous neutral salt solution using the aluminum plate as a cathode or an etching treatment comprising two or more of these treatments.

When a polishing treatment is performed before the anodization treatment, a more suitable aluminum support for lithographic printing plates can be obtained.

Furthermore, in the present invention, a hydrophilization treatment is preferably performed after the anodization treatment.

The anodization treatment is preferably performed under the conditions such that the sulfuric acid concentration is from 100 to 200 g/l, the concentration of aluminum ion contained in the aqueous sulfuric acid solution is from 2 to 10 g/l and the liquid temperature is from 30 to 40° C.

Alternatively, the anodization treatment is preferably performed under the conditions such that the sulfuric acid concentration is from 50 to 125 g/l, the concentration of aluminum ion contained in the aqueous sulfuric acid solution is from 2 to 10 g/l and the liquid temperature is from 40 to 70° C.

DETAILED DESCRIPTION OF THE INVENTION

Figure 1:
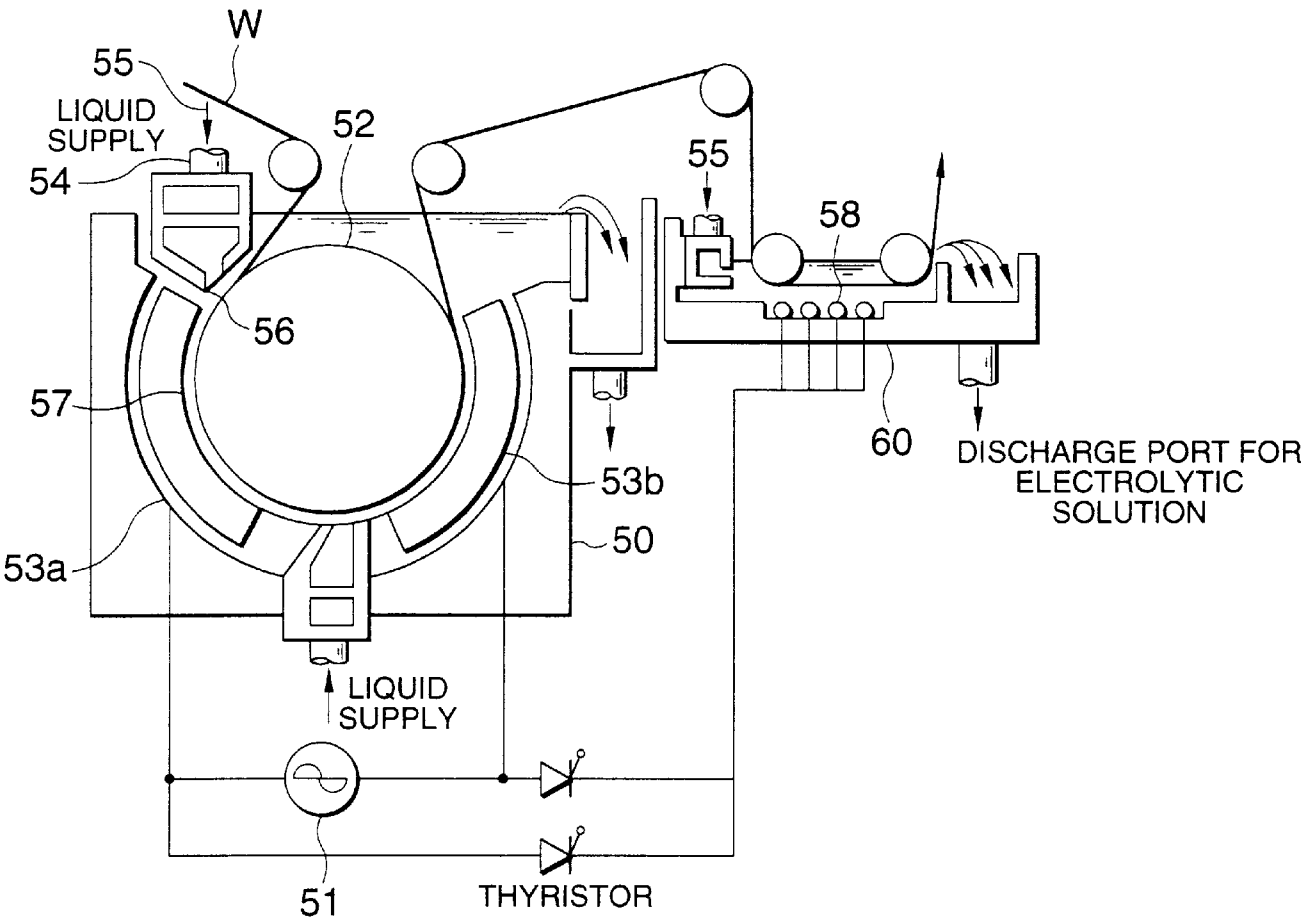
FIG. 1 is a schematic view showing one example of the electrolytic apparatus for use in the electrochemical surface roughening of the present invention.

The aluminum plate for use in the present invention is selected from a pure aluminum plate, an alloy plate mainly comprising an aluminum and containing trace foreign elements, and plastic film laminated or evaporated with aluminum. The trace foreign elements are selected from those described in the Periodic Table of Elements and the content thereof in the support is from 0.001 to 1.5 wt %. Representative examples of the foreign element contained in the aluminum alloy include silicon, iron, nickel, manganese, copper, magnesium, chromium, zinc, bismuth, titanium and vanadium. Usually, conventionally known materials described in *Aluminum Handbook*, 4th ed., Keikinzoku Kyokai (1990), for example, JIS A 1050, JIS A 3103, JIS A 3005, JIS A 1100 and JIS A 3004 materials and alloys obtained by adding 5 wt % or less of magnesium to these materials for the purpose of increasing the tensile strength may be used. The present invention is particularly suitable for surface roughening an aluminum plate where failures ascribable to the orientation of crystal grains occur.

The ratio among foreign elements contained in the aluminum alloy is such that Si is from 0.03 to 1.0 wt %, Fe is from 0.05 to 1.0 wt %, Cu is from 0.001 to 0.2 wt %, Ti is from 0.01 to 0.1 wt %, Mn is from 0 to 1.5 wt %, Mg is from 0.0 to 0.3 wt % and Zn is from 0 to 0.1 wt %, more preferably such that Si is from 0.05 to 0.15 wt %, Fe is from 0.1 to 0.3 wt %, Cu is from 0.1 to 0.02 wt %, Ti is from 0.02 to 0.03 wt %, Mn is from 0.01 to 0.03 wt %, Mg is from 0.01 to 0.03 wt % and Zn is from 0.01 to 0.02 wt %.

If the trace element is contained in a large amount, uniform honeycomb pits are difficult to form by the electrochemical surface roughening in an acidic aqueous solution. If the Si component is contained in a large amount, when the anodization treatment is applied after the surface roughening treatment, the anodic oxidation coating formed is defective, the defective portion is poor in the water retaining property, and the paper is readily stained on printing. If the Cu component is contained in a large amount, an area failing in forming honeycomb pits increases and an appearance failure occurs. When the Si component is contained in a large amount, the anodic oxidation coating preferably has an amount determined by a gravimetric method of 3 to 10 g/m$^2$.

The above-described aluminum plate may be produced by a continuous cast-rolling method other than an ordinary DC casting method. The continuous cast-rolling may be performed by a twin roller method, a belt caster method or a block caster method. The aluminum plate for use in the present invention has a thickness of approximately from 0.1 to 0.6 mm.

The aluminum plate prone to treatment unevenness in the alkali etching because of variation in the dissolving rate of aluminum due to difference in the orientation of crystal grains is preferably an aluminum plate produced by omitting intermediate annealing, soaking or both of intermediate annealing and soaking from the DC casting method or an aluminum plate produced by omitting intermediate annealing from the continuous casting method.

The term "an aluminum plate prone to treatment unevenness in the alkali etching because of variation in the dissolving rate of aluminum due to difference in the orientation of crystal grains" for use in the present invention means an aluminum plate where linear treatment unevenness called streaks or treatment unevenness called plane quality unevenness readily occur after the alkali etching treatment.

The surface roughening method of the present invention is suitable for uniformly surface roughening such an aluminum alloy plate that when an aluminum plate is buffed to have a mirror surface finish, alkali-etched in an aqueous caustic soda solution to dissolve 15 g/m$^2$ of the aluminum plate and then desmutted in an acidic aqueous solution and the surface thereof is observed by AMF, the roughness generated due to the difference in the etching rate is from 0.01 to 0.5 $\mu$m, preferably from 0.02 to 0.2 $\mu$m.

When the surface of an aluminum plate buffed and etched with hydrofluoric acid is observed, the crystal grain long in the rolled direction has a width of about 0.01 to 10 mm and a length of from 0.5 to 300 mm. The width of the crystal grain long in the rolled direction is preferably 5 mm or less, more preferably 3 mm or less.

The apparatus for use in the electrochemical surface roughening using DC or AC or in the electropolishing treatment or the electrolytic treatment of the present invention may be any known apparatus used in the continuous surface treatment of a metal web.

The aluminum plate of which surface is roughened by the method of the present invention is preferably subjected to an anodization treatment so as to increase the abrasion resistance on the surface of the aluminum plate. After the anodization treatment, a sealing treatment in boiling water or steam.

After the anodization treatment or after the anodization treatment and the hydrophilization treatment, a photosensitive layer or both an interlayer and a photo-sensitive layer is(are) coated and dried, whereby a PS plate having excellent printing performance can be obtained. On the photosensitive layer, a matting layer may be provided so as to attain good adhesion to the lithographic film at the time of vacuum printing. In order to prevent aluminum from dissolving out at the development, a backcoat layer may be provided on the back surface. The present invention can be applied to the production of not only a single side treated PS plate but also a double side treated PS plate.

Furthermore, the present invention can be applied not only to the surface roughening of an aluminum plate for lithographic printing plates but also to all kinds of aluminum plates.

Desmutting Treatment with Cathodic Electrolysis of Aluminum Plate

After the completion of preliminary electrochemical surface roughening treatment in an aqueous hydrochloric acid solution, the smut component mainly comprising aluminum hydroxide, which is produced by the electrochemical surface roughening, is removed, so that the subsequent electrochemical surface roughening in an acidic aqueous solution can be uniformly performed.

Figure 4:
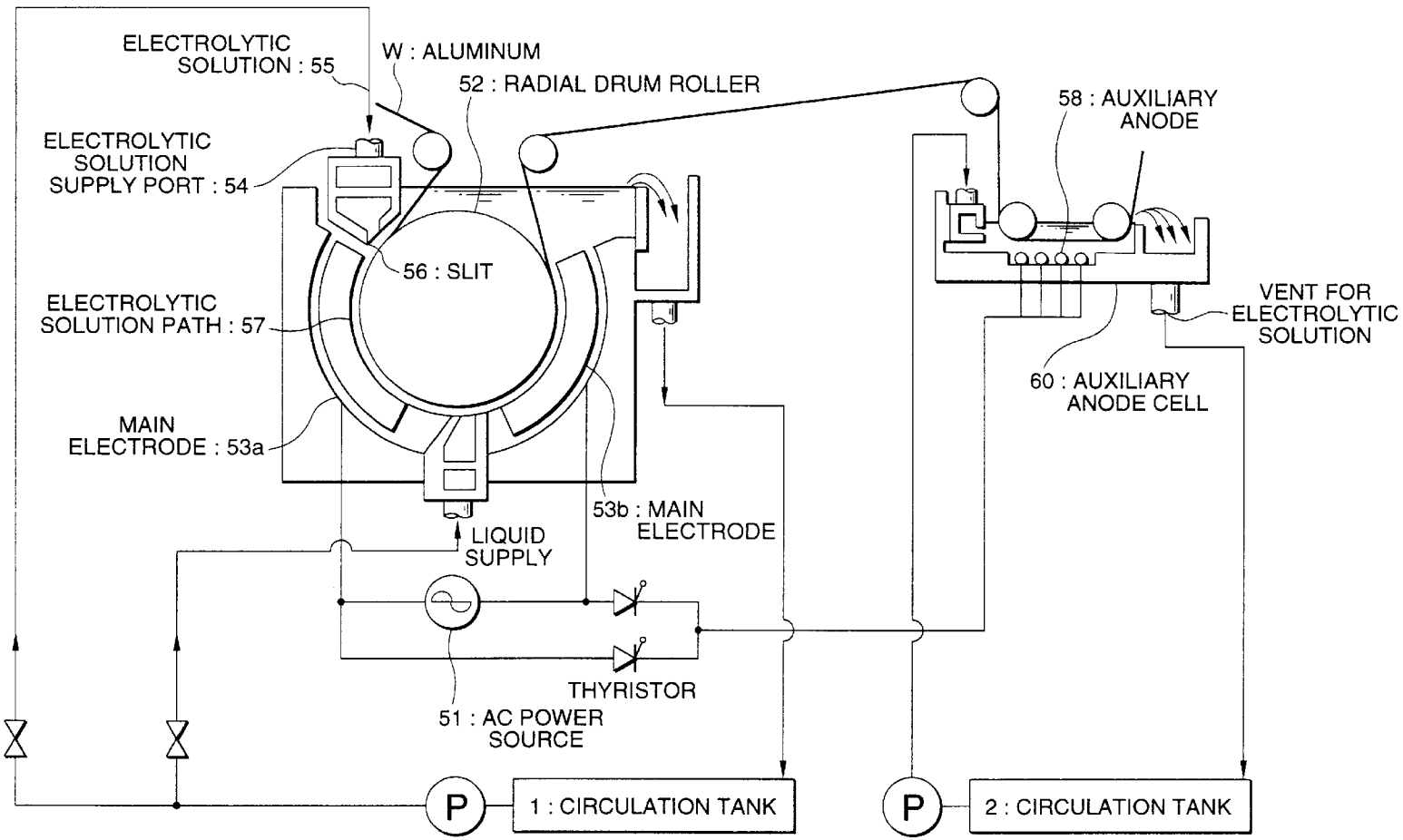
FIG. 4 is a schematic view showing one example of the electrolytic apparatus for use in the electrochemical surface roughening of the present invention.

At this time, the desmutting treatment is preferably performed while treating the aluminum plate by cathodic electrolysis. When the desmutting treatment is performed treating the aluminum plate by cathodic electrolysis, a hydrogen gas is generated and provides a stirring effect or the current generates heat on the aluminum interface, whereby the smut component mainly comprising aluminum hydroxide can be easily dissolved or fall off. For the desmutting treatment with cathodic electrolysis of the aluminum plate, an independent electrolytic apparatus may be provided, however, the cathodic electrolysis is preferably performed using an auxiliary anode cell of a known electrochemical surface roughening apparatus as shown in FIG. 4.

This is described below by referring to FIG. 4. Into an auxiliary anode cell equipped with an auxiliary anode, an electrolytic solution is circulated from a circulation tank different from a main electrolytic cell. While applying cathodic electrolysis to the aluminum plate using this auxiliary anode cell, the desmutting treatment is performed.

For the auxiliary anode, lead, iridium oxide, platinum and ferrite may be used.

The solution circulated into the auxiliary anode cell is preferably different from the aqueous solution circulated into the main electrolytic cell used for performing the electrochemical surface roughening, in one or more of the kind, the temperature or the composition of the solution. With respect to the kind of the solution, an aqueous solution of an acid, an alkali or a neutral salt may be used, however, in view of the quality stability during the process, an acidic aqueous solution is preferably used. For the acidic aqueous solution, a solution of hydrochloric acid, sulfuric acid, nitric acid, phosphoric acid, chromic acid or a mixture of two or more thereof may be used. The liquid temperature is from 25 to 90° C. and the concentration is from 0.1 to 40 wt %. The liquid temperature is preferably from 35 to 80° C. In this solution, aluminum ion may be dissolved in an amount of from 0 to 10 g/l, preferably from 0.5 to 8 g/l. Needless to say, the trace element contained in the aluminum plate can be dissolved in this solution though it is in a slight amount.

Among the above-described acidic aqueous solution, a solution of hydrochloric acid, sulfuric acid or nitric acid is preferred.

In the case where the desmutting treatment is performed while treating the aluminum plate by cathodic electrolysis using hydrochloric acid, the aqueous solution used has a hydrochloric acid concentration of from 1 to 100 g/l, preferably from 5 to 75 g/l. For the anode opposing the aluminum plate, iridium oxide or ferrite is preferably used.

In the case where the desmutting treatment is performed while treating the aluminum plate by cathodic electrolysis using sulfuric acid, the aqueous solution used has a sulfuric acid concentration of from 80 to 400 g/l, preferably from 100 to 350 g/l. For the anode opposing the aluminum plate, lead, iridium oxide, platinum or ferrite is preferably used.

In the case where the desmutting treatment is performed while treating the aluminum plate by cathodic electrolysis using nitric acid, the aqueous solution used has a nitric acid concentration of from 5 to 400 g/l, preferably from 10 to 350 g/l. For the anode opposing the aluminum plate, ferrite or platinum is preferably used.

In performing the desmutting treatment while treating the aluminum plate by cathodic electrolysis, a continuous or pulse DC is used. The current density is in terms of a peak value of the current preferably from 1 to 100 A/dm$^2$. The electrolysis time is preferably from 0.1 to 60 seconds and in the case of a continuous treatment, it is preferably from 0.5 to 10 seconds in view of equipment.

When the smut component cannot be completely removed by the desmutting treatment while applying cathodic electrolysis, a known chemical desmutting treatment in an aqueous acid or alkali solution may be used as an auxiliary.

Preliminary Electrochemical Surface Roughening in Aqueous Solution Mainly Comprising Hydrochloric Acid with Electricity Ouantity of from 1 to 300 C/dm$^2$ Using AC The aqueous solution mainly comprising hydrochloric acid used in the present invention may be one used in ordinary electrochemical surface roughening treatments using DC or AC. The aqueous solution may be obtained by adding from 1 g/l to saturation of one or more hydrochloric acid or nitric acid compound having nitrate ion such as aluminum nitrate, sodium nitrate and ammonium nitrate, or hydrochloride ion such as aluminum chloride, sodium chloride and ammonium chloride, to from 1 to 100 g/l of an aqueous hydrochloric acid solution. In the aqueous solution mainly comprising hydrochloric acid, a metal contained in the aluminum alloy, such as iron, copper, manganese, nickel, titanium, magnesium and silica, may be dissolved. A hypochlorous acid may also be added.

For preliminarily forming fine unevenness in an aqueous solution mainly comprising hydrochloric acid using AC, the aqueous solution is preferably prepared by adding an aluminum salt to an aqueous solution at a liquid temperature of from 15 to 45° C. containing from 5 to 15 g/l of hydrochloric acid to have an aluminum ion concentration of from 3 to 50 g/l.

With respect to the additives to the aqueous solution mainly comprising hydrochloric acid, the apparatus, the power source, the current density, the flow rate and the temperature, those used in known electrochemical surface roughening treatment may be used. An aqueous solution mainly comprising a nitric acid or a hydrochloric acid is preferred. The power source for use in the electrochemical surface roughening treatment may be AC or DC, but AC is preferred.

In the electrochemical surface roughening in an aqueous solution mainly comprising hydrochloric acid, the quantity of electricity participating in the anodic reaction of the aluminum plate is from the range of from 1 to 300 C/cm$^2$, preferably from 5 to 150 C/dm$^2$, more preferably from 10 to 100 C/dm$^2$.

After the fine unevenness is formed by the electrochemical surface roughening, smut or oxide film is produced, therefore, in order to uniformly perform the subsequent electrochemical surface roughening, a slight etching treatment of dissolving from 0.01 to 5 g/m$^2$, more preferably from 0.01 to 1.5 g/dm$^2$, of the aluminum plate is preferably performed in an aqueous acid or alkali solution.

The electrochemical surface roughening with an electricity quantity of from 1 to 300 C/dm$^2$ in an aqueous solution mainly comprising hydrochloric acid using AC is preferably performed such that an unetched portion is completely absent and uniform pits are formed over the entire surface or such that even if an unetched portion is present, the unetched portions are uniformly dispersed.

In the preliminary surface roughening, the AC used preferably has a frequency of from 50 to 500 Hz, more preferably from 50 to 250 Hz, still more preferably from 100 to 250 Hz.

By using an AC having a frequency higher than a commercial frequency, the aluminum support for lithographic printing plates obtained is white and can have excellent suitability for plate inspection.

Electropolishing Treatment in Aqueous Alkali Solution

This electrochemical polishing treatment in an aqueous alkali solution is a treatment performed using an aqueous solution of a sole alkaline material such as sodium hydroxide, potassium hydroxide, sodium carbonate and sodium phosphate, or an aqueous solution of a mixture of these materials, a mixture of the alkaline material with zinc hydroxide or aluminum hydroxide, or a mixture of the alkaline material with a salt such as sodium chloride or potassium chloride, where the aluminum is used as an anode and electrolyzed with an electrolytic solution having such a composition, a temperature and a concentration as to give an electrically deoxidized material. In order to stably produce a uniform oxide film, hydrogen peroxide or a phosphate may be added in a concentration of 1 wt % or less. A known aqueous solution for use in the electropolishing may be used, however, preferred is an aqueous solution mainly comprising sodium hydroxide, more preferred is an aqueous solution containing from 2 to 30 wt % of sodium hydroxide, and still more preferred is an aqueous solution containing from 3 to 20% of sodium hydroxide. The liquid temperature is from 10 to 90° C. (preferably from 35 to 60° C.), the current density is from 1 to 200 A/dm$^2$ (preferably from 20 to 80 A/dm$^2$), and the electrolysis time is from 1 to 180 seconds. The current used may be a DC, a pulse DC or an AC but a continuous DC is preferred. The electrolysis treatment apparatus used may be an apparatus known for the electrolysis treatment, such as flat-type cell and radial-type cell.

After the completion of electropolishing treatment, squeezing of solution through nip rollers and water washing by spraying are preferably performed so as not to carry over the processing solution to the next step.

It is more preferred that before or after or both before and after the electropolishing treatment, a chemical etching of dissolving from 0.01 to 3 g/dm$^2$ of the aluminum plate is performed in an aqueous acid or alkali solution.

Electropolishing Treatment in Acidic Aqueous Solution

In the present invention, for the electropolishing treatment of an aluminum plate in an acidic aqueous solution, a known aqueous solution used in electropolishing may be used but preferred is an aqueous solution mainly comprising a sulfuric acid or a phosphoric acid, and more preferred is an aqueous solution containing from 20 to 90 wt % (preferably from 40 to 80 wt %) of a sulfuric acid or a phosphoric acid. The liquid temperature is from 10 to 90° C. (preferably from 50 to 80° C.), the current density is from 1 to 200 A/dm$^2$ (preferably from 5 to 80 A/dm$^2$), and the electrolysis time is from 1 to 180 seconds. In this aqueous solution, a sulfuric acid, a phosphoric acid, a chromic acid, a hydrogen peroxide, a citric acid, a boric acid, a hydrofluoric acid, a phthalic acid anhydride or the like may be added in an amount of from 1 to 50 wt %. Furthermore, the aqueous solution may contain, needless to say about aluminum, from 0 to 10 wt % of alloy components contained in the aluminum alloy. The sulfate ion or phosphate ion concentration and the aluminum ion concentration each is preferably selected from the range of not causing crystallization even at an ordinary temperature.

The current used may be a DC, a pulse DC or an AC but a continuous DC is preferred. The electrolysis treatment apparatus used may be an apparatus known for the electrolysis treatment, such as flat-type cell and radial-type cell. After the completion of electropolishing treatment, squeezing of solution through nip rollers and water washing by spraying are preferably performed so as not to carry over the processing solution to the next step.

It is more preferred that before or after or both before and after the electropolishing treatment, a chemical etching of dissolving from 0.01 to 3 g/dm$^2$ of the aluminum plate is performed in an aqueous acid or alkali solution.

Electrolysis Treatment in Aqueous Neutral Salt Solution Using Aluminum Plate as Anode or Cathode The aqueous neutral salt solution for use in the present invention is an aqueous solution of a salt described in JP-A-52-26904 and JP-A-59-11295. The salt includes alkali metal halide or alkali metal nitric acid salts. Among these, sodium chloride and sodium nitrate are preferred, and sodium nitrate are more preferred. The pH is from 5 to 9, preferably from 6 to 8. However, the pH is from 5 to 9 in the vicinity of the aluminum plate or the electrode interface.

The concentration is preferably from 1 to 40%. With respect to the electrode opposing to the aluminum plate for use in the electrolysis of the present invention, carbon and stainless steel may be used for the cathode, and platinum, ferrite and iridium oxide may be used for the anode. The DC for use in the electrolysis using the aluminum plate as an anode or a cathode preferably has a current density of from 1 to 200 A/dm$^2$, the electrolysis time is preferably from 0.1 to 90 seconds and the liquid temperature is preferably from 35 to 75° C.

In the aqueous salt solution at a particularly preferred pH of from 6 to 8, the dissolved aluminum ion precipitates in the form of an aluminum hydroxide or an aluminum oxide hydrate. However, these may be continuously removed from the aqueous neutral salt solution by filtration or centrifugation.

In the case of performing a treatment of dissolving an aluminum plate while applying an electrolysis treatment in an aqueous neutral salt solution using the aluminum plate as a cathode, an auxiliary anode cell shown in FIG. 1 for use in the electrochemical surface roughening treatment using AC is preferably used.

Chemical Etching Treatment in Aqueous Acid or Alkali Solution

The aqueous alkali solution preferably has a concentration of from 1 to 30 wt % and may contain, needless to say about aluminum, from 0 to 10 wt % of alloy components contained in the aluminum alloy. The aqueous alkali solution is preferably an aqueous solution mainly comprising caustic soda. The treatment is preferably performed at a liquid temperature of from 30 to 95° C. for from 1 to 120 seconds.

Examples of the acid which can be used in the acidic aqueous solution include a phosphoric acid, a nitric acid, a sulfuric acid, a chromic acid, a hydrochloric acid and a mixed acid containing two or more of these acids. The acidic aqueous solution preferably has a concentration of from 0.5 to 65 wt % and may contain, needless to say about aluminum, from 0 to 10 wt % of alloy components contained in the aluminum alloy. The treatment is preferably performed at a liquid temperature of from 30 to 95° C. for from 1 to 120 seconds. The acidic aqueous solution is preferably an aqueous sulfuric acid solution. The sulfuric acid concentration and the aluminum concentration each is preferably selected from the range of not causing crystallization at an ordinary temperature.

After the completion of etching treatment, squeezing of solution through nip rollers and water washing by spraying are preferably performed so as not to carry over the processing solution to the next step.

Desmutting Treatment in Acidic Aqueous Solution

In the case where a chemical etching is performed using an aqueous alkali solution, where an electrolytic treatment is performed in an aqueous neutral salt solution using the aluminum plate as a cathode or where an electropolishing treatment is performed in an aqueous alkali solution, smut is generated on the aluminum surface. In this case, a desmutting treatment is performed using a phosphoric acid, a nitric acid, a sulfuric acid, a chromic acid, a hydrochloric acid or a mixed acid containing two or more of these acids. The acidic aqueous solution preferably has a concentration of from 0.5 to 60 wt %. Furthermore, in the acidic aqueous solution, from 0 to 5 wt % of alloy components contained in the aluminum alloy, needless to say about aluminum, may be contained. The liquid temperature is from an ordinary temperature to 95° C. and the treatment time is preferably from 1 to 120 seconds. After the completion of desmutting treatment, squeezing of solution through nip rollers and water washing by spraying are preferably performed so as not to carry over the processing solution to the next step.

Mechanical Surface Roughening Treatment

In the present invention, the mechanical surface roughening treatment is preferably performed using a rotating nylon brush roller having a bristle size of from 0.2 to 1.61 mm while feeding a slurry solution to the aluminum plate surface. The abrasive may be a known material, however, quartz sand, quartz, aluminum hydroxide and a mixture thereof are preferred. These are described in detail in JP-A-6-135175 and JP-B-50-40047 (the term "JP-B" as used herein means an "examined Japanese patent publication"). The slurry solution preferably has a specific gravity of from 1.05 to 1.3.

Of course, a method of spraying a slurry solution, a method using a wire brush or a method of transferring the uneven surface shape of a rolling roller to the aluminum plate may also be used. Other methods are described in JP-A-55-074898, JP-A-61-162351 and JP-A-63-104889.

Aqueous Solution Mainly Comprising Nitric Acid

The aqueous solution mainly comprising nitric acid for use in the present invention may be one used in ordinary electrochemical surface roughening treatments using a DC or AC. The aqueous solution may be obtained by adding from 1 g/l to saturation of one or more hydrochloric acid or nitric acid compound having nitrate ion such as aluminum nitrate, sodium nitrate and ammonium nitrate, or hydrochloride ion such as aluminum chloride, sodium chloride and ammonium chloride, to from 1 to 400 g/l of an aqueous nitric acid solution. In the aqueous solution mainly comprising nitric acid, a metal contained in the aluminum alloy, such as iron, copper, manganese, nickel, titanium, magnesium and silica, may be dissolved. A solution obtained by adding aluminum chloride or aluminum nitrate to an aqueous solution containing from 5 to 20 g/l of nitric acid, to have an aluminum ion concentration of from 3 to 50 g/l is preferred. The temperature is preferably from 10 to 95° C., more preferably from 40 to 80° C.

Electrochemical Surface Roughening Using AC

The acidic aqueous solution for use in the present invention may be one used in ordinary electrochemical surface roughening treatments using DC or AC. The acidic aqueous solution is preferably selected from the above-described aqueous solutions mainly comprising nitric acid or hydrochloric acid.

The AC power source waveform which can be used in the electrochemical surface roughening includes sine waveform, square waveform, trapezoidal waveform and triangle waveform. Among these, square waveform and trapezoidal waveform are preferred, and trapezoidal waveform is more preferred. The frequency is preferably from 0.1 to 500 Hz.

In the case of trapezoidal waveform, the time tp necessary for the current starting from 0 to reach the peak is preferably from 0.1 to 10 msec, more preferably from 0.3 to 2 msec. If tp is less than 0.1, a large power source voltage is necessary at the rising of the current waveform probably because of an effect by an impedance of a power source circuit and this increases the equipment cost for the power source, whereas if tp exceeds 10 msec, the treatment is readily affected by the trace components in the electrolytic solution and uniform surface roughening becomes difficult to attain.

The conditions in one cycle for the AC used in the electrochemical surface roughening is preferably such that the ratio (tc/ta) of the anode reaction time (ta) of the aluminum plate to the cathode reaction time (tc) is from 1 to 20, the ratio (Qc/Qa) of the electricity quantity (Qc) when the aluminum plate is in an anode time to the electricity quantity (Qa) in a cathode time is from 0.3 to 20, and the anode reaction time (ta) is from 5 to 1,000 msec. The tc/ta is more preferably from 2.5 to 15 and the Qc/Qa is more preferably from 2.5 to 15.

The current density is, in terms of the peak value of the trapezoidal wave, preferably from 10 to 200 A/dm$^2$ in both the anode cycle side (Ia) and the cathode cycle side (Ic) of the current. The Ic/Ia is preferably from 0.3 to 20.

After the completion of the electrochemical surface roughening, the total quantity of electricity participating in the anode reaction of the aluminum plate is preferably from 1 to 1,000 C/dm$^2$.

With respect to the electrolytic cell used in the electrochemical surface roughening using AC according to the present invention, known electrolytic cells used in the surface treatment, such as vertical-type cell, flat-type cell and radial-type cell, may be used, however, a radial-type electrolytic cell disclosed in JP-A-5-195300 is preferred. The electrolytic solution passing through the electrolytic cell may flow in parallel with or counter to the proceeding of the aluminum web. It is also possible to use two or more electrolytic cells.

For the electrochemical surface roughening using AC, an apparatus shown in FIG. 1 may be used. When two or more electrolytic cells are used, the electrolysis conditions may be the same or different therebetween.

An aluminum plate W is wound around a radial drum roller 52 disposed to sink in a main electrolytic cell 50 and on the way of transportation, electrolyzed by main electrodes 53*a* and 53*b* connected to an AC power source 51. An electrolysis solution 55 is fed from an electrolytic solution supply port 54 to an electrolytic solution path 57 between the radial drum roller 52 and the main electrodes 53*a* and 53*b* through a slit 56. The aluminum plate W treated in the main electrolytic cell 50 is subsequently electrolyzed in an auxiliary anode cell 60. In this auxiliary anode cell 60, an auxiliary anode 58 is disposed to oppose the aluminum plate W and the electrolytic solution 55 is fed to run through the space between the auxiliary anode 58 and the aluminum plate W.

Electrochemical Surface Roughening Using DC

The electrochemical surface roughening using DC according to the present invention means a method of applying a DC current between an aluminum plate and electrodes opposing it to perform electrochemical surface roughening. The electrolytic solution may be one used in known electrochemical surface roughening treatments using DC or AC, but an aqueous solution mainly comprising a nitric acid or a hydrochloric acid, or an aqueous neutral salt solution is preferred.

The temperature is preferably from 10 to 80° C. The treating apparatus for use in the electrochemical surface roughening using DC may be a known apparatus using DC, however, an apparatus where one or more pairs of anode and cathode are alternately arranged described in JP-A-1-141094 is preferably used. Examples of known apparatuses are described in JP-A-6-328876, JP-A-8-67078, JP-A-61-19115 and JP-B-57-44760. The electrochemical surface roughening treatment may also be performed by applying a DC current between a conductor roller contacting with the aluminum plate and a cathode opposing it, using the aluminum plate as an anode. After the completion of electrolysis, squeezing of solution through nip rollers and water washing by spraying are preferably performed so as not to carry over the processing solution to the next step. The DC used in the electrochemical surface roughening is preferably DC having a ripple ratio of 20% or less. The current density is preferably from 10 to 200 A/dm$^2$ and the quantity of electricity when the aluminum plate is in the anode time is preferably from 1 to 1,000 C/dm$^2$. The anode may be selected from known electrodes for oxygen generation, such as ferrite, iridium oxide, platinum and platinum cladded or plated to a valve metal (e.g., titanium, niobium, zirconium). The cathode may be selected from the electrodes used as a cathode of fuel cells, such as carbon, platinum, titanium, niobium, zirconium and stainless steel.

Heat Treatment

In the present invention, the heat treatment means to heat the aluminum plate to a temperature of from 70 to 700° C. and thereby generate acid- or alkali-insoluble matters on the aluminum surface. The insoluble matters generated serve as a resist at the etching in an aqueous acid or alkali solution, whereby fine unevenness is formed to disturb clear viewing of streaks. The heating time is preferably from 0.01 second to 120 minutes. The temperature of the aluminum plate in air is preferably from 200 to 600° C.

Examples of the method for producing insoluble matters include:

(1) a method of heating an aluminum plate having attached thereon smut components mainly comprising aluminum hydroxide produced by the electrochemical surface roughening treatment, in air or inert gas to produce insoluble matters;

(2) a method of heating an aluminum plate having attached thereon smut components mainly comprising aluminum hydroxide produced by the electrochemical surface roughening treatment, in pure water to produce insoluble matters; and (3) a method of heating an aluminum plate free of smut components mainly comprising aluminum hydroxide produced by the electrochemical surface roughening treatment, in pure water to produce insoluble matters.

Examples of the heating method include:

(1) a method of blowing a heated gas;

(2) a method of heating an aluminum web by wrapping it around a heated pass roll;

(3) a method of induction heating aluminum;

(4) a method of heating in boiling water; and (5) a method of using (1) to (4) above in combination.

In addition, known heating methods may be used.

Polishing Treatment

In the present invention, the polishing treatment means a mechanical, electrical, chemical or thermal polishing treatment.

The mechanical polishing treatment includes jet-spraying of abrasive grains, jet-spraying of water, spraying of magnetic abrasive grains, magnetic polishing, belt grinding, brushing and liquid honing. The electrical polishing includes ultrasonic polishing. The thermal polishing include polishing by plasma, discharge work or laser work. In industry, mechanical polishing is preferred and the aluminum surface is preferably polished using a nylon brush or a wheel or roller made of rubber, cloth, non-woven fabric, nylon fabric, sponge, felt, leather or burnishing cloth. The mechanical polishing treatment is preferably performed in a wet system rather than in a dry system because scratching large enough to come out into an appearance failure is difficult to occur. The wet mechanical polishing is preferably performed while spraying water or a solution capable of etching aluminum or in water or a solution capable of etching aluminum. Irrespective of wet or dry, the polishing treatment is preferably performed using an abrasive together because the surface can be effectively rounded with a small energy.

After the polishing treatment, for the purpose of removing cutting debris or abrasive, a water washing treatment or a chemical etching treatment of dissolving from 0.01 to 1 g/m$^2$ of the aluminum plate in an aqueous acid or alkali solution is preferably performed.

When from 0.01 to 30 g/m$^2$, preferably from 0.1 to 3 g/m$^2$ of the aluminum plate is dissolved using an aqueous acid or alkali solution before the mechanical polishing, the surface of the aluminum plate is softened and thereby the mechanical polishing is facilitated.

It is considered that by mechanically polishing the aluminum plate, protrusions on the aluminum support after the surface roughening treatment are cut, as a result, catching of an ink scarcely occurs on printing and the printed matter is mostly free from staining or on supplying a fountain solution, the sponge is not easily hooked.

The aluminum plate may be horizontally rubbed with a nylon brush, sponge, rubber, non-woven fabric or leather for use in the mechanical polishing. A roller material may be rotated. In the case of preparing a roller material and rotating it, the rotating rate is preferably different between the aluminum plate and the outer circumference of the roller. The mechanical polishing is preferably performed using an abrasive having an average particle size of from 0.001 to 0.1 $\mu$m as a polishing aid. Also, glass or zirconia balls having an average diameter of from 0.1 to 5 mm may be used as an aid. The abrasive preferably has a round shape with least sharpened corners. The polishing effect may be attained either in a dry system or a wet system, however, a wet system is preferred in the point that scratches are difficultly formed. In a wet system, the liquid has a lubricating action and an action of cleaning cutting debris, therefore, scratching scarcely occurs. The liquid to this purpose is preferably water because it is harmless, however, an aqueous acid or alkali solution containing from 0 to 10 wt % of aluminum ion and having a concentration of from 0.01 to 30 wt % may be used. Specific examples of the aqueous acid or alkali solution include an aqueous solution of caustic soda, sulfuric acid or phosphoric acid.

In the case of using a liquid containing an abrasive, an aqueous solution having a concentration of from 0.1 to 50 wt % is preferred. The abrasive is preferably alumina, silica or aluminum hydroxide. The wet mechanical polishing is performed at a liquid temperature of from −30 to 90° C. and a pressure of from 0.001 to 100 kg/cm$^2$ with a difference in the rotating rate from the aluminum plate of from 0.001 to 100 m/sec. With respect to the rotating direction of rollers used for the polishing, a roller rotating in the forward direction and a roller rotating in the reverse direction to the proceeding direction of the aluminum plate are preferably used in combination. More preferred is to alternately dispose from one to three pairs of a roller rotating in the forward direction and a roller rotating in the reverse direction. The rotation number is preferably from 150 to 300 rpm and the diameter of the roller used for the polishing is preferably from 300 to 600 mm.

A plurality of wheels, rollers or sections for the polishing may be used in combination.

In the case of performing the polishing treatment by spraying water or a liquid of acid or alkali on the surface of the aluminum plate under polishing or by dipping the aluminum plate in the liquid, the liquid preferably has a viscosity of from 1 to 200 cp, more preferably from 1.5 to 50 cp. When the viscosity of the liquid is increased, a liquid film is easily formed on the aluminum surface and the aluminum surface is almost prevented from scratching. For increasing the viscosity, a thickener is added. The thickener is preferably a polymer compound. The viscosity may be increased by adding from 0.01 to 60 wt % of polyethylene glycol or by adding from 0.01 to 5 wt % of a polymer coagulant for use in the water treatment or waste water treatment. The polymer coagulant includes nonionic, anionic and polyacrylic acid-base coagulants. Examples of the commercially available coagulant which can be used include PN-161, PN-162, PN-133, PN-171, PA-328, PA-371, PA-322, PA-331, PA-349, PA-372, PA-318, PA-362, PA-363, PA-364, PA-365, PA-374, PA-375, PA-376, PA-377, PA-378, PA-379, PA-312, LC-541 and LC-551 produced by Kurita Kogyo K.K.

Anodization Treatment

The anodization treatment is applied so as to increase the abrasion resistance on the surface of the aluminum plate. The electrolyte used in the anodization treatment of the aluminum plate may be any as long as it forms a porous oxide film. In general, sulfuric acid, phosphoric acid, oxalic acid, chromic acid or a mixed solution thereof is used. The concentration of the electrolyte may be appropriately determined depending on the kind of the electrolyte. The conditions for the anodization treatment vary depending on the electrolyte used and cannot be definitely specified, however, suitable conditions are generally such that the concentration of the electrolyte is from 1 to 80 wt %, the liquid temperature is from 5 to 70° C., the current density is from 1 to 60 A/dm$^2$, the voltage is from 1 to 100 V and the electrolysis time is from 10 to 300 seconds.

The sulfuric acid method is usually performed using DC, however, AC also may be used.

The amount of the anodic oxidation coating is suitably from 1 to 10 g/m$^2$, preferably from 1 to 5 g/m$^2$. If the amount of the anodic oxidation coating is less than 1 g/m$^2$, the printing durability is insufficient, the non-image area of the lithographic printing plate is prone to scratching and at the same time, adhesion of ink to the scratched portion, so-called scratch staining, readily occurs, whereas if the amount of anodic oxidation coating increases, the oxide film is liable to concentrate in the aluminum edge part. The difference in the amount of the anodic oxidation coating between the edge part and the center part of the aluminum plate is preferably 1 g/m$^2$ or less.

Figure 5:
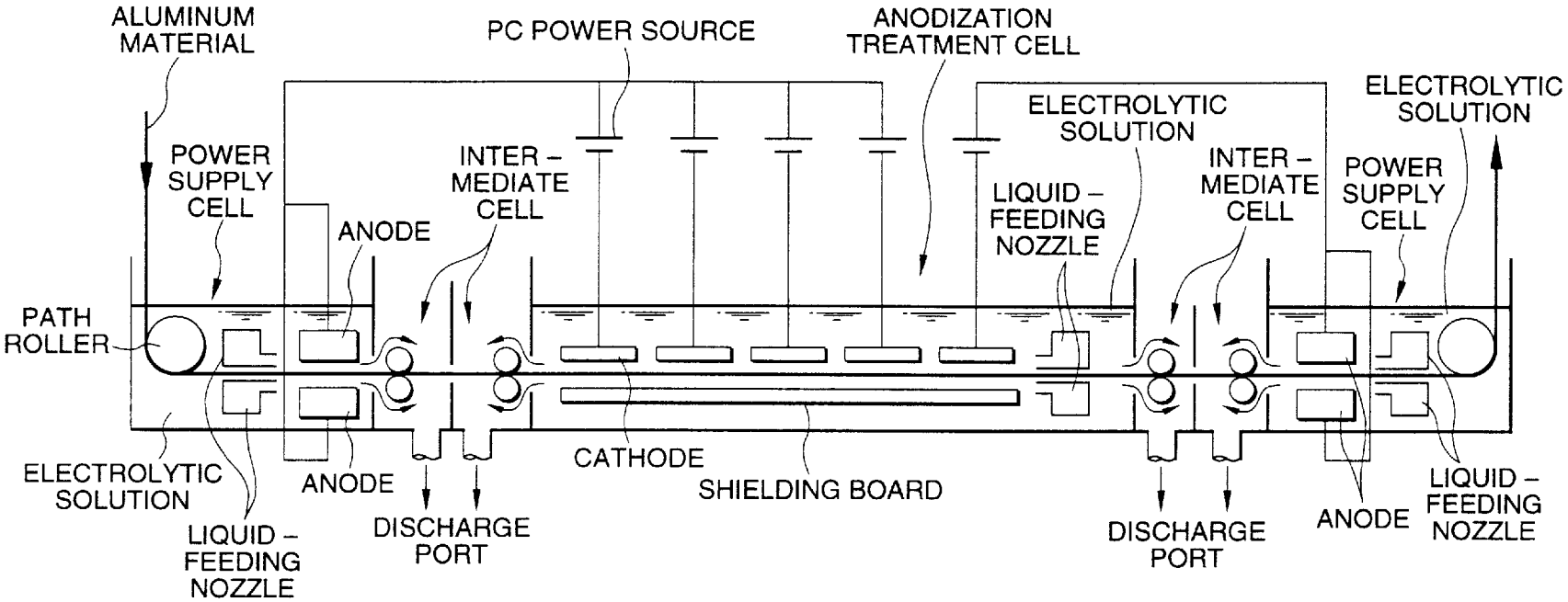
FIG. 5 is a schematic view showing one example of the apparatus for use in the electrolytic oxidation treatment of the present invention.
Figure 6:
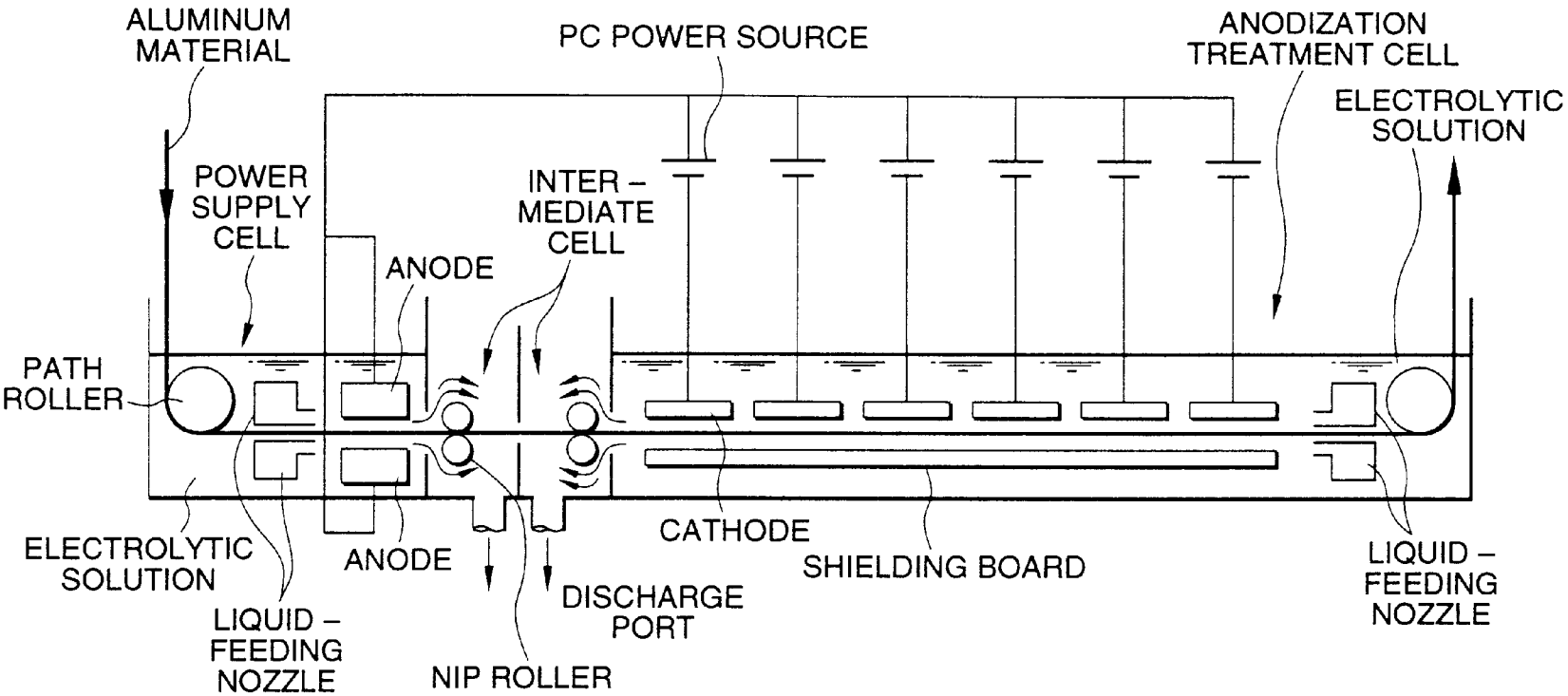
FIG. 6 is a schematic view showing another example of the apparatus for use in the electrolytic oxidation treatment of the present invention.

The anodization in an aqueous sulfuric acid solution is described in detail in JP-A-54-128453 and JP-A-48-45303. The sulfuric acid concentration is preferably from 10 to 300 g/l and the aluminum ion concentration is preferably from 1 to 25 g/l. The aluminum concentration is more preferably adjusted to from 2 to 10 g/l by adding aluminum sulfate to from 50 to 200 g/l of an aqueous sulfuric acid solution. The liquid temperature is preferably from 30 to 60° C. In the case of using a DC method, the current density is from 1 to 60 A/dm$^2$, preferably from 5 to 40 A/dm$^2$. In the case of continuously anodizing an aluminum sheet, it is preferred to start the anodization treatment at a low current density of from 5 to 10 A/dm$^2$ so as to prevent the concentration of current called aluminum plate burning, and in the latter stage, to gradually increase the current density until from 30 to 50 A/dm$^2$ or to set the current density to be larger than that. The current density is preferably elevated gradually through from 5 to 15 steps. In each step, an independent power source unit is provided and the current density is controlled by the current value of this power source unit. The power supply is preferably performed by a liquid supply system using no conductor roller. FIGS. 5 and 6 each is a schematic view showing the anodization process. In order to minimize the power supply loss, the liquid concentration and temperature of a cell called a power supply cell is usually set to be higher than those in the anodization treatment cell. For the electrode in the power supply cell, iridium oxide or lead is used and for the electrode in the anodization treatment cell, aluminum is used.

FIG. 5 shows one example of an apparatus for performing an anodization treatment used in the present invention. In this example, power supply cells are provided to sandwich an anodization treatment cell for forming an anodic oxidation coating. FIG. 6 shows another example of the similar apparatus, where a power supply tank is disposed upstream on the traveling direction of the aluminum plate and an anodization treatment cell is disposed downstream.

In these apparatuses, an anode is provided in the power supply cell and the aluminum plate undergoes a cathodic reaction. Accordingly, an anodic oxidation coating is formed on the aluminum plate surface. The distance between the aluminum plate and the cathode is preferably from 50 to 200 mm. For the cathode, aluminum is used. For the cathodes each connected to a DC power source, an electrode having a large area is not used so as to facilitate escaping of hydrogen gas generated but the cathode is preferably divided into several parts perpendicularly to the traveling direction of the aluminum sheet.

Between the power supply cell and the anodization treatment cell, a cell called an intermediate cell of not allowing the electrolytic solution to stay is provided. By providing this intermediate cell, the current can be prevented from by-passing from the anode to the cathode without passing through the aluminum plate. In the intermediate cell, nip rollers are preferably provided to squeeze the solution and reduce the by-pass current as much as possible. In the power supply tank, the electrolytic solution is set to have a higher temperature or a higher concentration than that in the anodization treatment cell, so as to reduce the voltage loss. The composition and the temperature of the electrolytic solution in the anodization treatment cell are selected by taking account of the efficiency in the formation of an anodic oxidation coating, the shape of micropores on the anodic oxidation coating, the hardness of the anodic oxidation coating, the voltage, the cost of the electrolytic solution and the like. To the power supply cell or the anodization treatment cell, the electrolytic solution is fed by jetting it from a liquid-feeding nozzle. The liquid-feeding nozzle is designed to have a slit and thereby calm the liquid flow jetted to be constant in the cross direction, so as to attain a constant distribution of the electrolytic solution and prevent local concentration of the current on the aluminum plate in the anodization treatment cell. In the anodization treatment cell, a shielding board is provided in the opposite side to the electrode with intervention of the aluminum plate to prevent the current from running in the side opposite to the surface where an anodic oxidation coating is intended to form. The distance between the aluminum plate and the shielding board is preferably from 5 to 30 mm. A plurality of DC power sources are preferably used by commonly connecting their plus sides. By this, the current distribution in the anodization treatment cell can be controlled.

In the aqueous sulfuric acid solution, a slight amount of trace elements contained in the aluminum plate can be of course dissolved.

During the anodization treatment, aluminum dissolves out into the aqueous sulfuric acid solution, therefore, the sulfuric acid concentration and the aluminum ion concentration must be controlled to control the process. If the aluminum ion concentration is set to a low level, the aqueous sulfuric acid solution used for the anodization must be renewed very often and the waste water amount increases, which causes problems not only in the profitability but also environmental aspect. On the other hand, if the aluminum ion concentration is set to a high level, a high voltage is necessary for the electrolysis and the cost for the electric power increases, thus, this is not profitable.

The sulfuric acid concentration, the aluminum ion concentration and the liquid temperature in the anodization are preferably as follows:

(Case 1)

sulfuric acid concentration:

from 100 to 200 g/l (more preferably from 130 to 180 g/l)

aluminum ion concentration:

from 2 to 10 g/l (more preferably from 3 to 7 g/l)

liquid temperature:

from 30 to 40° C. (more preferably from 33 to 38° C.)

(Case 2)

sulfuric acid concentration:

from 50 to 125 g/l (more preferably from 80 to 120 g/l)

aluminum ion concentration:

from 2 to 10 g/l (more preferably from 3 to 7 g/l)

liquid temperature:

from 40 to 70° C. (more preferably from 50 to 60° C.)

After the anodization treatment, the aluminum plate surface is subjected to a hydrophilization treatment, if desired. Examples of the hydrophilization treatment for use in the present invention include an alkali metal silicate (e.g., aqueous sodium silicate solution) method described in U.S. Pat. Nos. 2,714,066, 3,181,461, 3,280,734 and 3,902,734. In this method, the support is dipped or electrolyzed in an aqueous sodium silicate solution. The Si amount measured by a fluorescent X-ray device is preferably from 0.1 to 100 $mg/m^2$, more preferably from 1 to 50 $mg/m^2$. Other than this, a method of treating the aluminum plate with potassium fluorozirconate disclosed in JP-B-36-22063 or with polyvinylphosphonic acid disclosed in U.S. Pat. Nos. 3,276,868, 4,153,461 and 4,689,272 may be used.

Furthermore, after the graining and anodization treatments, the aluminum plate is also preferably subjected to a sealing treatment. The sealing treatment is performed by dipping the aluminum plate in hot water or a hot aqueous solution containing an inorganic or organic salt, or using a steam bath or the like.

EXAMPLES

The present invention is described in greater detail below by referring to the Examples.

Example 1

A JIS A 1050 aluminum plate having a thickness of 0.24 mm and a width of 1,030 mm was prepared by omitting intermediate annealing and soaking in a DC casting method to provide a state such that streaking or plane quality unevenness readily occurs at the chemical etching in an aqueous acid or alkali solution, and then continuously treated as follows.

(1) Mechanical Surface Roughening Treatment

The surface of the aluminum plate was mechanically roughened by means of a rotating roller nylon brush while feeding a suspension of quartz sand in water, having a specific gravity of 1.12 as an abrasive slurry solution to the surface of the aluminum plate. The nylon brush was formed of 6·10 nylon and had a bristle length of 50 mm and a bristle diameter of 0.295 mm. The nylon brush was obtained by densely fastening bristles to holes punched on a stainless steel-made cylinder of ϕ300 mm. Three rotating brushes were used. At the lower portion of each brush, two holding rollers (ϕ200 mm) were provided at a distance of 300 mm. The brush rollers were impressed until the load of the drive motor for rotating the brush reached +4.5 kw based on the load before the brush rollers were impressed to the aluminum plate. The brush was rotated in the same direction as the direction in which the aluminum plate was moving. Thereafter, the aluminum plate was washed with water. The moving rate of the aluminum plate was 50 m/min.

(2) Etching Treatment in Aqueous Alkali Solution

The aluminum plate was then etched by dipping it in an aqueous solution containing 27 wt % of NaOH and 6.5 wt % of aluminum ion at 70° C. to dissolve 10 $g/m^2$ of the aluminum plate. Thereafter, the aluminum plate was washed with water.

(3) Desmutting Treatment

The aluminum plate was then desmutted by dipping it in an aqueous solution containing 1 wt % of hydrochloric acid at 35° C. for 10 seconds. Thereafter, the aluminum plate was washed with water.

Figure 2:
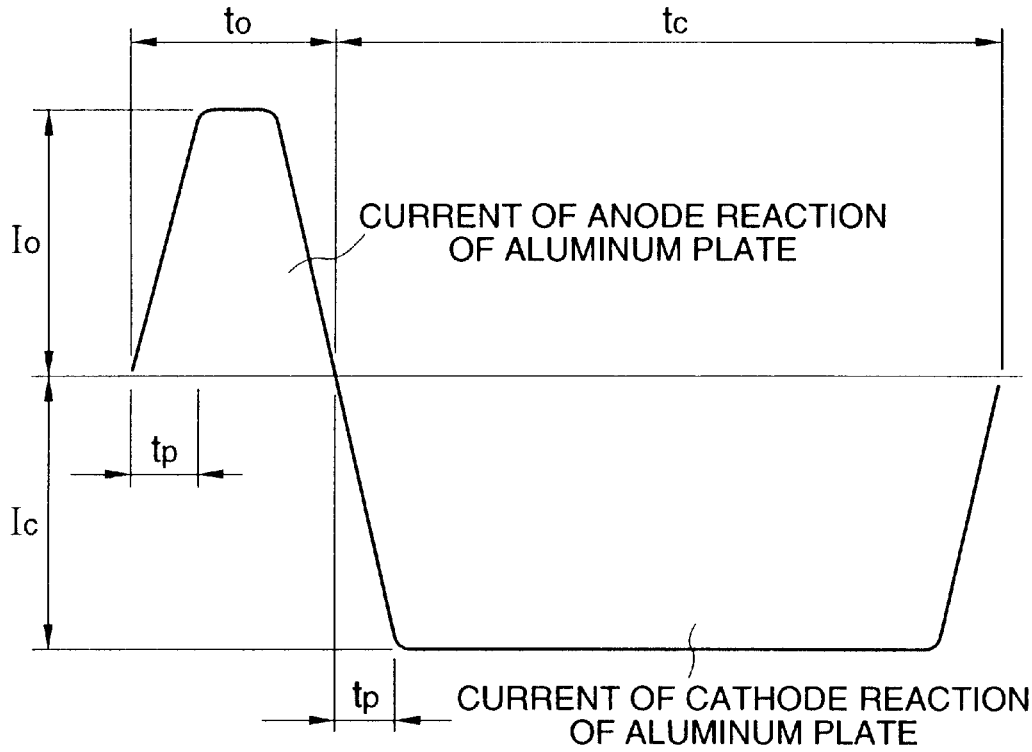
FIG. 2 is a waveform diagram showing one example of the trapezoidal AC power source waveform for use in the electrochemical surface roughening of the present invention.

(4) Preliminary Electrochemical Surface Roughening Treatment in Aqueous Hydrochloric Acid Solution Using an AC voltage shown in FIG. 2 and one unit of an apparatus shown in FIG. 1, an electrochemical surface roughening treatment was continuously performed. At this time, the electrolytic solution used was an aqueous 1 wt % hydrochloric acid solution (containing 0.5 wt % of aluminum ion) and the liquid temperature was 35° C. The AC power source waveform used was a trapezoidal square waveform AC having a time TP necessary for the current value starting from 0 to reach the peak, of 1 msec, a duty ratio of 1:1 and a frequency of 60 Hz. Furthermore, carbon electrode was used for the counter electrode and ferrite was used for the auxiliary anode.

The current density in terms of a current peak value was 50 A/dm$^2$ and the electricity quantity in terms of a total electricity quantity when the aluminum plate was in an anode time, was 50 C/dm$^2$. The current flowing from the power source was divided by 5% into the auxiliary anode.

Thereafter, the aluminum plate was washed with water by spraying.

(5) Etching Treatment in Aqueous Alkali Solution

The aluminum plate was then etched by dipping it in an aqueous solution containing 27 wt % of NaOH and 6.5 wt % of aluminum ion at 40° C. to dissolve 0.3 g/m$^2$ of the aluminum plate. Thereafter, the aluminum plate was washed with water.

(6) Desmutting Treatment

The aluminum plate was then desmutted by dipping it in an aqueous 1 wt % nitric acid solution (containing 0.5 wt % of aluminum ion and 0.007 wt % of ammonium ion) at 35° C. for 10 seconds. Thereafter, the aluminum plate was washed with water.

(7) Electrochemical Surface Roughening Treatment in Aqueous Nitric Acid Solution Using an AC voltage shown in FIG. 2 and two units of an apparatus shown in FIG. 1, an electrochemical surface roughening treatment was continuously performed. At this time, the electrolytic solution used was an aqueous 1 wt % nitric acid solution (containing 0.5 wt % of aluminum ion and 0.007 wt % of ammonium ion) and the liquid temperature was 50° C. The AC power source waveform used was a trapezoidal square waveform AC having a time tp necessary for the current value starting from 0 to reach the peak, of 1 msec, a duty ratio of 1:1 and a frequency of 60 Hz. Furthermore, carbon electrode was used for the counter electrode and ferrite was used for the auxiliary anode.

The current density in terms of a current peak value was 50 A/dm$^2$ and the electricity quantity in terms of a total electricity quantity when the aluminum plate was in an anode time, was 210 C/dm$^2$. The current flowing from the power source was divided by 5% into the auxiliary anode. Thereafter, the aluminum plate was washed with water by spraying.

(8) Heating Treatment

The aluminum plate having attached thereon smuts mainly comprising aluminum hydroxide formed in the step of electrochemical surface roughening in an aqueous solution mainly comprising nitric acid was heat treated in air at a temperature of 200° C. for 90 minutes (Example 1-1), for 30 minutes (Example 1-2) or for 1 minute (Example 1-3), or heat treated in air at a temperature of 100° C. for 90 minutes (Example 1-4) or in air at a temperature of 300° C. for 1 minute (Example 1-5).

(9) Etching Treatment in Aqueous Alkali Solution

The aluminum plate was then etched by dipping it in an aqueous solution containing 26 wt % of NaOH and 6.5 wt % of aluminum ion at 45° C. to dissolve 1 g/m$^2$ of the aluminum plate. Thereafter, the aluminum plate was washed with water.

(10) Desmutting Treatment

The aluminum plate was then desmutted by dipping it in an aqueous solution containing 25 wt % of sulfuric acid at 60° C. Thereafter, the aluminum plate was washed with water.

(11) Anodization Treatment

The aluminum plate was then anodized in an aqueous solution having a sulfuric acid concentration of 100 g/l (containing 7 g/l of aluminum ion) at a liquid temperature of 55° C. using a DC voltage at a current density of 2 A/dm$^2$ to have an amount of anodic oxidation coating of 2.4 g/m$^2$. Thereafter, the aluminum plate was washed with water by spraying.

The surface of each aluminum plate thus treated was free from occurrence of streaking ascribable to the orientation of crystal grains, and generation of plane quality unevenness.

On each of the thus-obtained aluminum plates, an interlayer and a photosensitive layer were coated and dried to prepare a positive PS plate having a dry thickness of 2.0 g/m$^2$. Using each PS plate, printing was performed, as a result, these were verified to be a good printing plate.

Example 2

For the purpose of hydrophilization, the substrate after the anodization treatment in (11) of Example 1 was dipped in an aqueous solution containing 2.5 wt % of sodium silicate at 70° C. for 14 seconds. Thereafter, the substrate was washed with water by spraying and then dried. After each treatment and water washing, the solution was squeezed through nip rollers.

On each of the thus-treated aluminum plates, an interlayer and a negative photosensitive layer were coated and dried to prepare a PS plate. Using each PS plate, printing was performed, as a result, these were verified to be a good printing plate.

Example 3

The surface roughening treatment was performed thoroughly in the same manner as in Example 1 except for using an induction heating in the heat treatment in (8) of Example 1. The induction heating time was 0.1 second. It is estimated that the temperature of the aluminum plate elevated up to 500° C. The surface of the thus-treated aluminum plate was free from occurrence of streaking ascribable to the orientation of crystal grains, and generation of plane quality unevenness.

Example 4

The aluminum plate was treated thoroughly in the same manner as in Example 1 except that in place of the chemical etching treatment in an aqueous alkali solution in (9) of Example 1, an electropolishing treatment was performed in an aqueous solution containing 9 wt % of caustic soda and 0.5 wt % of aluminum ion at 35° C. and a current density of 20 A/dm$^2$ using the aluminum plate as an anode to dissolve 1 g/m$^2$ of the aluminum plate. On each of the thus-treated aluminum plates, an interlayer and a negative photosensitive layer were coated and dried to prepare a PS plate. Using each PS plate, printing was performed, as a result, these were verified to be a good printing plate.

Example 5

A JIS A 1050 aluminum plate having a thickness of 0.24 mm and a width of 1,030 mm was prepared by omitting intermediate annealing and soaking in a DC casting method to provide a state such that streaking or plane quality unevenness readily occurs at the chemical etching in an aqueous acid or alkali solution, and then continuously treated as follows.

(1) Mechanical Surface Roughening Treatment

The surface of the aluminum plate was mechanically roughened by means of a rotating roller nylon brush while feeding a suspension of quartz sand in water, having a specific gravity of 1.12 as an abrasive slurry solution to the surface of the aluminum plate. The nylon brush was formed of 6·10 nylon and had a bristle length of 50 mm and a bristle diameter of 0.295 mm. The nylon brush was obtained by densely fastening bristles to holes punched on a stainless steel-made cylinder of ϕ300 mm. Three rotating brushes were used. At the lower portion of each brush, two holding rollers (ϕ200 mm) were provided at a distance of 300 mm. The brush rollers were impressed until the load of the drive motor for rotating the brush reached +4 kw based on the load before the brush rollers were impressed to the aluminum plate. The brush was rotated in the same direction as the direction in which the aluminum plate was moving. Thereafter, the aluminum plate was washed with water. The moving rate of the aluminum plate was 50 m/min.

(2) Etching Treatment in Aqueous Alkali Solution

The aluminum plate was then etched by dipping it in an aqueous solution containing 27 wt % of NaOH and 6.5 wt % of aluminum ion at 70° C. to dissolve 6 g/m$^2$ of the aluminum plate. Thereafter, the aluminum plate was washed with water.

(3) Desmutting Treatment

The aluminum plate was then desmutted by dipping it in an aqueous solution containing 1 wt % of nitric acid at 35° C. for 5 seconds. Thereafter, the aluminum plate was washed with water.

(4) Electrochemical Surface Roughening Treatment in Aqueous Nitric Acid Solution Using an AC voltage shown in FIG. 2 and two units of an apparatus shown in FIG. 1, an electrochemical surface roughening treatment was continuously performed. At this time, the electrolytic solution was an aqueous 1 wt % nitric acid solution (containing 0.5 wt % of aluminum ion and 0.007 wt % of ammonium ion) and the liquid temperature was 50° C. The AC power source waveform used was a trapezoidal square waveform AC having a time tp necessary for the current value starting from 0 to reach the peak, of 1 msec, a duty ratio of 1:1 and a frequency of 60 Hz. Furthermore, carbon electrode was used for the counter electrode and ferrite was used for the auxiliary anode.

The current density in terms of a current peak value was 50 A/dm$^2$ and the electricity quantity in terms of a total electricity quantity when the aluminum plate was in an anode time, was 210 C/dm$^2$. The current flowing from the power source was divided by 5% into the auxiliary anode. Thereafter, the aluminum plate was washed with water by spraying.

(5) Etching Treatment in Aqueous Alkali Solution

The aluminum plate was then etched by dipping it in an aqueous solution containing 27 wt % of NaOH and 6.5 wt % of aluminum ion at 40° C. to dissolve 0.5 g/m$^2$ of the aluminum plate. Thereafter, the aluminum plate was washed with water.

(6) Desmutting Treatment

The aluminum plate was then desmutted by dipping it in an aqueous solution containing 1 wt % of hydrochloric acid at 35° C. for 5 seconds. Thereafter, the aluminum plate was washed with water.

(7) Electrochemical Surface Roughening Treatment in Aqueous Hydrochloric Acid Solution Using an AC voltage shown in FIG. 2 and one unit of an apparatus shown in FIG. 1, an electrochemical surface roughening treatment was continuously performed. At this time, the electrolytic solution used was an aqueous 1 wt % hydrochloric acid solution (containing 0.5 wt % of aluminum ion) and the liquid temperature was 35° C. The AC power source waveform used was a trapezoidal square waveform AC having a time tp necessary for the current value starting from 0 to reach the peak, of 1 msec, a duty ratio of 1:1 and a frequency of 60 Hz. Furthermore, carbon electrode was used for the counter electrode and ferrite was used for the auxiliary anode.

The current density in terms of a current peak value was 50 A/dm$^2$ and the electricity quantity in terms of a total electricity quantity when the aluminum plate was in an anode time, was 75 C/dm$^2$. The current flowing from the power source was divided by 5% into the auxiliary anode.

Thereafter, the aluminum plate was washed with water by spraying.

(8) Heating Treatment

The aluminum plate having attached thereon smuts mainly comprising aluminum hydroxide formed in the step of electrochemical surface roughening in an aqueous solution mainly comprising hydrochloric acid was heat treated in air at a temperature of 200° C. for 90 minutes.

(9) Etching Treatment in Aqueous Alkali Solution

The aluminum plate was then etched by dipping it in an aqueous solution containing 26 wt % of NaOH and 6.5 wt % of aluminum ion at 45° C. to dissolve 0.3 g/m$^2$ of the aluminum plate. Thereafter, the aluminum plate was washed with water.

(10) Desmutting Treatment

The aluminum plate was then desmutted by dipping it in an aqueous 25 wt % sulfuric acid solution (containing 0.5 wt % of aluminum ion) at 60° C. for 5 seconds. Thereafter, the aluminum plate was washed with water.

(11) Anodization Treatment

The aluminum plate was then anodized in an aqueous solution having a sulfuric acid concentration of 100 g/l (containing 7 g/l of aluminum ion) at a liquid temperature of 50° C. using a DC voltage at a current density of 2 A/dm$^2$ to have an amount of anodic oxidation coating of 1.8 g/m$^2$. Thereafter, the aluminum plate was washed with water by spraying.

The surface of the thus-treated aluminum plate was free from occurrence of streaking ascribable to the orientation of crystal grains, and generation of plane quality unevenness.

On the aluminum plate obtained, an interlayer and a photosensitive layer were coated and dried to prepare a positive PS plate having a dry thickness of 2.0 g/m$^2$. Using this PS plate, printing was performed, as a result, this plate was verified to be a good printing plate having an excellent inking property.

Example 6

For the purpose of hydrophilization, the substrate after the anodization treatment in Example 5 was dipped in an aqueous solution containing 2.5 wt % of sodium silicate at 70° C. for 14 seconds. Thereafter, the substrate was washed with water by spraying and then dried. After each treatment and water washing, the solution was squeezed through nip rollers. On the thus-treated aluminum plate, an interlayer and a negative photosensitive layer were coated and dried to prepare a PS plate. Using this PS plate, printing was performed, as a result, this plate was verified to be a good printing plate.

Example 7

A JIS A 1050 aluminum plate having a thickness of 0.24 mm and a width of 1,030 mm was prepared by omitting intermediate annealing and soaking in a DC casting method to provide a state such that streaking or plane quality unevenness readily occurs at the chemical etching in an aqueous acid or alkali solution, and then continuously treated as follows.

(1) Etching Treatment in Aqueous Alkali Solution

The aluminum plate was etched by dipping it in an aqueous solution containing 27 wt % of NaOH and 6.5 wt % of aluminum ion at 70° C. to dissolve 6 g/m$^2$ of the aluminum plate. Thereafter, the aluminum plate was washed with water.

(2) Desmutting Treatment

The aluminum plate was then desmutted by dipping it in an aqueous solution containing 1 wt % of hydrochloric acid at 35° C. for 5 seconds. Thereafter, the aluminum plate was washed with water.

(3) Electrochemical Surface Roughening Treatment in Aqueous Hydrochloric Acid Solution Using an AC voltage shown in FIG. 2 and one unit of an apparatus shown in FIG. 1, an electrochemical surface roughening treatment was continuously performed. At this time, the electrolytic solution used was an aqueous 1 wt % hydrochloric acid solution (containing 0.5 wt % of aluminum ion) and the liquid temperature was 35° C. The AC power source waveform used was a trapezoidal square waveform AC having a time tp necessary for the current value starting from 0 to reach the peak, of 0.5 msec, a duty ratio of 1:1 and a frequency of 60 Hz. Furthermore, carbon electrode was used for the counter electrode and ferrite was used for the auxiliary anode.

The current density in terms of a current peak value was 50 A/dm$^2$ and the electricity quantity in terms of a total electricity quantity when the aluminum plate was in an anode time, was 50 C/dm$^2$. The current flowing from the power source was divided by 5% into the auxiliary anode.

Thereafter, the aluminum plate was washed with water by spraying.

(4) Etching Treatment in Aqueous Alkali Solution

The aluminum plate was then etched by dipping it in an aqueous solution containing 27 wt % of NaOH and 6.5 wt % of aluminum ion at 40° C. to dissolve 0.3 g/m$^2$ of the aluminum plate. Thereafter, the aluminum plate was washed with water.

(5) Desmutting Treatment

The aluminum plate was then desmutted by dipping it in an aqueous solution containing 1 wt % of nitric acid at 35° C. for 5 seconds. Thereafter, the aluminum plate was washed with water.

(6) Electrochemical Surface Roughening Treatment in Aqueous Nitric Acid Solution Using an AC voltage shown in FIG. 2 and two units of an apparatus shown in FIG. 1, an electrochemical surface roughening treatment was continuously performed. At this time, the electrolytic solution used was an aqueous 1 wt % nitric acid solution (containing 0.5 wt % of aluminum ion and 0.007 wt % of ammonium ion) and the liquid temperature was 70° C. The AC power source waveform used was a trapezoidal square waveform AC having a time tp necessary for the current value starting from 0 to reach the peak, of 0.8 msec, a duty ratio of 1:1 and a frequency of 60 Hz. Furthermore, carbon electrode was used for the counter electrode and ferrite was used for the auxiliary anode.

The current density in terms of a current peak value was 50 A/dm$^2$ and the electricity quantity in terms of a total electricity quantity when the aluminum plate was in an anode time, was 230 C/dm$^2$. The current flowing from the power source was divided by 5% into the auxiliary anode. Thereafter, the aluminum plate was washed with water by spraying.

(7) Heating Treatment

The aluminum plate having attached thereon smuts mainly comprising aluminum hydroxide formed in the step of electrochemical surface roughening in an aqueous solution mainly comprising nitric acid was heat treated in air at a temperature of 200° C. for 90 minutes.

(8) Etching Treatment in Aqueous Alkali Solution

The aluminum plate was then etched by dipping it in an aqueous solution containing 5 wt % of NaOH and 0.5 wt % of aluminum ion at 40° C. to dissolve 0.1 g/m$^2$ of the aluminum plate. Thereafter, the aluminum plate was washed with water.

(9) Desmutting Treatment

The aluminum plate was then desmutted by dipping it in an aqueous 25 wt % sulfuric acid solution (containing 0.5 wt % of aluminum ion) at 60° C. for 5 seconds. Thereafter, the aluminum plate was washed with water.

(10) Anodization Treatment

The aluminum plate was then anodized in an aqueous solution having a sulfuric acid concentration of 170 g/l (containing 3 g/l of aluminum ion) at a liquid temperature of 35° C. using a DC voltage at a current density of 2 A/dm$^2$ to have an amount of anodic oxidation coating of 2.4 g/m$^2$. Thereafter, the aluminum plate was washed with water by spraying.

The surface of the thus-treated aluminum plate was free from occurrence of streaking ascribable to the orientation of crystal grains, and generation of plane quality unevenness.

On the aluminum plate obtained, an interlayer and a photosensitive layer were coated and dried to prepare a positive PS plate having a dry thickness of 2.0 g/m$^2$. This PS plate was verified to be a good printing plate.

Example 8

For the purpose of hydrophilization, the substrate after the anodization treatment in Example 7 was dipped in an aqueous solution containing 2.5 wt % of sodium silicate at 70° C. for 14 seconds. Thereafter, the substrate was washed with water by spraying and then dried. After each treatment and water washing, the solution was squeezed through nip rollers. On the thus-treated aluminum plate, an interlayer and a negative photosensitive layer were coated and dried to prepare a PS plate. Using this PS plate, printing was performed, as a result, this plate was verified to be a good printing plate.

Example 9

The surface roughening treatment was performed thoroughly in the same manner as in Example 7 except for performing a buffing treatment before the chemical etching treatment in (1) of Example 7. The surface of the thus-treated aluminum plate was almost free from occurrence of streaking ascribable to the orientation of crystal grains, and generation of plane quality unevenness.

On the aluminum plate obtained, an interlayer and a photosensitive layer were coated and dried to prepare a positive PS plate having a dry thickness of 2.0 g/m$^2$. This PS plate was verified to be a good printing plate.

Example 10

For the purpose of hydrophilization, the substrate after the anodization treatment in Example 9 was dipped in an aqueous solution containing 2.5 wt % of sodium silicate at 70° C. for 14 seconds. Thereafter, the substrate was washed with water by spraying and then dried. After each treatment and water washing, the solution was squeezed through nip rollers. On the thus-treated aluminum plate, an interlayer and a negative photosensitive layer were coated and dried to prepare a PS plate. Using this PS plate, printing was performed, as a result, this plate was verified to be a good printing plate.

Example 11

The surface roughening treatment was performed thoroughly in the same manner as in Example 1 except that a polishing treatment was performed before the anodization treatment (11) and the amount of the anodic oxidation coating was changed to 1.2 g/m$^2$ in Example 1. For the polishing treatment, the apparatus shown in FIG. 3 was used. The polishing treatment was performed using 4 rollers each made of a close-texture nylon non-woven fabric and the rollers each had a diameter of 300 mm and rotated at 200 rpm.

The non-woven fabric rollers and the aluminum plate were sunk in water and the viscosity was adjusted to 17 CP by adding a polymer coagulant. In order to avoid attachment of dusts, the solution was passed through a filter before the use.

The lithographic printing plate obtained was used in a proofing machine. When an operator supplied a fountain solution with a sponge, hooking of the sponge did not occur, thus, this plate was verified to be a good printing plate of not easily allowing the generation of sponge debris. Furthermore, streaking and plane quality unevenness were not generated, therefore, the aluminum plate had no unevenness on the surface and exhibited good suitability for plate inspection.

Example 12

The substrate after anodization treatment in Example 1 was hydrophilized by dipping it in an aqueous 0.2% polyvinylsulfonic acid solution at 70° C. for 5 seconds. On the thus-treated aluminum plate, a photosensitive layer was coated to prepare a printing plate, then, a good printing plate was obtained.

Comparative Example 1

The surface roughening treatment was performed thoroughly in the same manner as in Example 1 except that the heat treatment was not performed in Example 1. On this aluminum plate, streaks ascribable to the orientation of crystal grains were severely generated as compared with Example 1.

Example 13

A JIS A 1050 aluminum plate having a thickness of 0.24 mm and a width of 1,030 mm was prepared by omitting intermediate annealing and soaking in a DC casting method to provide a state such that streaking or plane quality unevenness readily occurs at the chemical etching in an aqueous acid or alkali solution, and then continuously treated as follows.

(1) Mechanical Surface Roughening Treatment

The surface of the aluminum plate was mechanically roughened by means of a rotating roller nylon brush while feeding a suspension of quartz sand in water, having a specific gravity of 1.12 as an abrasive slurry solution to the surface of the aluminum plate. The nylon brush was formed of 6·10 nylon and had a bristle length of 50 mm and a bristle diameter of 0.295 mm. The nylon brush was obtained by densely fastening bristles to holes punched on a stainless steel-made cylinder of ϕ300 mm. Three rotating brushes were used. At the lower portion of each brush, two holding rollers (ϕ200 mm) were provided at a distance of 300 mm. The brush rollers were impressed until the load of the drive motor for rotating the brush reached +4.5 kw based on the load before the brush rollers were impressed to the aluminum plate. The brush was rotated in the same direction as the direction in which the aluminum plate was moving. Thereafter, the aluminum plate was washed with water. The moving rate of the aluminum plate was 50 m/min.

(2) Etching Treatment in Aqueous Alkali Solution

The aluminum plate was then etched by dipping it in an aqueous solution containing 27 wt % of NaOH and 6.5 wt % of aluminum ion at 70° C. to dissolve 10 g/m$^2$ of the aluminum plate. Thereafter, the aluminum plate was washed with water.

(3) Desmutting Treatment

The aluminum plate was then desmutted by dipping it in an aqueous solution containing 1 wt % of hydrochloric acid at 35° C. for 10 seconds. Thereafter, the aluminum plate was washed with water.

(4) Preliminary Electrochemical Surface Roughening Treatment in Aqueous Hydrochloric Acid Solution Using an AC voltage in FIG. 2 and one unit of an apparatus shown in FIG. 1, an electrochemical surface roughening treatment was continuously performed. At this time, the electrolytic solution used was an aqueous 1 wt % hydrochloric acid solution (containing 0.5 wt % of aluminum ion) and the liquid temperature was 35° C. The AC power source waveform used was a trapezoidal square waveform AC having a time tp necessary for the current value starting from 0 to reach the peak, of 0.5 msec, a duty ratio of 1:1 and a frequency of 60 Hz. Furthermore, carbon electrode was used for the counter electrode.

The current density in terms of a current peak value was 50 A/dm$^2$ and the electricity quantity in terms of a total electricity quantity when the aluminum plate was in an anode time, was 50 C/dm$^2$. The current flowing from the power source was divided by 5% into an auxiliary anode.

(5) Electrolytic Treatment in Aqueous Neutral Salt Solution Using Aluminum Plate as Cathode The aluminum plate was then electrolyzed using an aqueous sodium chloride solution in a concentration of 100 g/l at a liquid temperature of 70° C. for the auxiliary anode of (4) above.

For the electrode, ferrite was used. Thereafter, the aluminum plate was washed with water.

(6) Desmutting Treatment

The aluminum plate was then desmutted by dipping it in an aqueous 1 wt % nitric acid solution (containing 0.5 wt % of aluminum ion and 0.007 wt % of ammonium ion) at 35° C. for 10 seconds. Thereafter, the aluminum plate was washed with water.

(7) Electrochemical Surface Roughening Treatment in Aqueous Nitric Acid Solution Using an AC voltage shown in FIG. 2 and two units of an apparatus shown in FIG. 1, an electrochemical surface roughening treatment was continuously performed. At this time, the electrolytic solution used was an aqueous 1 wt % nitric acid solution (containing 0.5 wt % of aluminum ion and 0.007 wt % of ammonium ion) and the liquid temperature was 50° C. The AC power source waveform used was a trapezoidal square waveform AC having a time tp necessary for the current value starting from 0 to reach the peak, of 1 msec, a duty ratio of 1:1 and a frequency of 60 Hz. Furthermore, carbon electrode was used for the counter electrode and ferrite was used for the auxiliary anode.

The current density in terms of a current peak value was 50 A/dm$^2$ and the electricity quantity in terms of a total electricity quantity when the aluminum plate was in an anode time, was 210 c/dm$^2$. The current flowing from the power source was divided by 5% into the auxiliary anode. Thereafter, the aluminum plate was washed with water by spraying.

(8) Etching Treatment in Aqueous Alkali Solution

The aluminum plate was then etched by dipping it in an aqueous solution containing 26 wt % of NaOH and 6.5 wt % of aluminum ion at 45° C. to dissolve 1 g/m$^2$ of the aluminum plate. Thereafter, the aluminum plate was washed with water.

(9) Desmutting Treatment

The aluminum plate was then desmutted by dipping it in an aqueous 25 wt % sulfuric acid solution at 60° C. Thereafter, the aluminum plate was washed with water.

(10) Anodization Treatment

The aluminum plate was then anodized in an aqueous solution having a sulfuric acid concentration of 80 g/l (containing 2 g/l of aluminum ion) at a liquid temperature of 55° C. using a DC voltage at a current density of 2 A/dm$^2$ to have an amount of anodic oxidation coating of 2.4 g/m$^2$. Thereafter, the aluminum plate was washed with water by spraying.

The surface of the thus-treated aluminum plate was free from occurrence of streaking ascribable to the orientation of crystal grains, and generation of plane quality unevenness.

On the aluminum plate obtained, an interlayer and a photosensitive layer were coated and dried to prepare a positive PS plate having a dry thickness of 2.0 g/m$^2$. Using this PS plate, printing was performed, as a result, this plate was verified to be a good printing plate.

Example 14

The surface treatment was performed thoroughly in the same manner as in Example 13 except that after the electrochemical surface roughening treatment in (7) of Example 13, the aluminum plate having attached thereon smuts mainly comprising aluminum hydroxide formed in the step of electrochemical surface roughening was heat treated in air at a temperature of 200° C. for 90 minutes. The surface of the thus-treated aluminum plate was observed and found to be free of occurrence of streaking ascribable to the orientation of crystal grains and generation of plane quality unevenness.

Example 15

For the purpose of hydrophilization, the substrate after the anodization treatment in Example 13 was dipped in an aqueous solution containing 2.5 wt % of sodium silicate at 70° C. for 14 seconds. Thereafter, the substrate was washed with water by spraying and then dried. After each treatment and water washing, the solution was squeezed through nip rollers. On the thus-treated aluminum plate, an interlayer and a negative photosensitive layer were coated and dried to prepare a PS plate. Using this PS plate, printing was performed, as a result, this plate was verified to be a good printing plate.

Example 16

A JIS A 1050 aluminum plate having a thickness of 0.24 mm and a width of 1,030 mm was prepared by omitting intermediate annealing and soaking in a DC casting method to provide a state such that streaking or plane quality unevenness readily occurs at the chemical etching in an aqueous acid or alkali solution, and then continuously treated as follows.

(1) Mechanical Surface Roughening Treatment

The surface of the aluminum plate was mechanically roughened by means of a rotating roller nylon brush while feeding a suspension of quartz sand in water, having a specific gravity of 1.12 as an abrasive slurry solution to the surface of the aluminum plate. The nylon brush was formed of 6·10 nylon and had a bristle length of 50 mm and a bristle diameter of 0.48 mm. The nylon brush was obtained by densely fastening bristles to holes punched on a stainless steel-made cylinder of ϕ300 mm. Three rotating brushes were used. At the lower portion of each brush, two holding rollers (ϕ200 mm) were provided at a distance of 300 mm. The brush rollers were impressed until the load of the drive motor for rotating the brush reached +4 kw based on the load before the brush rollers were impressed to the aluminum plate. The brush was rotated in the same direction as the direction in which the aluminum plate was moving. Thereafter, the aluminum plate was washed with water. The moving rate of the aluminum plate was 50 m/min.

(2) Etching Treatment in Aqueous Alkali Solution

The aluminum plate was then etched by dipping it in an aqueous solution containing 27 wt % of NaOH and 6.5 wt % of aluminum ion at 70° C. to dissolve 6 g/m$^2$ of the aluminum plate. Thereafter, the aluminum plate was washed with water.

(3) Desmutting Treatment

The aluminum plate was then desmutted by dipping it in an aqueous solution containing 1 wt % of nitric acid at 35° C. for 5 seconds. Thereafter, the aluminum plate was washed with water.

(4) Electrochemical Surface Roughening Treatment in Aqueous Nitric Acid Solution Using an AC voltage shown in FIG. 2 and two units of an apparatus shown in FIG. 1, an electrochemical surface roughening treatment was continuously performed. At this time, the electrolytic solution used was an aqueous 1 wt % nitric acid solution (containing 0.5 wt % of aluminum ion and 0.007 wt % of ammonium ion) and the liquid temperature was 50° C. The AC power source waveform used was a trapezoidal square waveform AC having a time tp necessary for the current value starting from 0 to reach the peak, of 1 msec, a duty ratio of 1:1 and a frequency of 60 Hz. Furthermore, carbon electrode was used for the counter electrode and ferrite was used for the auxiliary anode.

The current density in terms of a current peak value was 50 A/dm$^2$ and the electricity quantity in terms of a total electricity quantity when the aluminum plate was in an anode time, was 210 C/dm$^2$. The current flowing from the power source was divided by 5% into the auxiliary anode. Thereafter, the aluminum plate was washed with water by spraying.

(5) Electrolytic Treatment in Aqueous Neutral Salt Solution Using Aluminum Plate as Cathode The aluminum plate was then electrolyzed using an aqueous sodium nitrate solution in a concentration of 160 g/l at a liquid temperature of 70° C. for the auxiliary anode of (4) above.

For the electrode, ferrite was used. Thereafter, the aluminum plate was washed with water.

(6) Desmutting Treatment

The aluminum plate was then desmutted by dipping it in an aqueous solution containing 1 wt % of hydrochloric acid at 35° C. for 5 seconds. Thereafter, the aluminum plate was washed with water.

(7) Electrochemical Surface Roughening Treatment in Aqueous Hydrochloric Acid Solution Using an AC voltage in FIG. 2 and one unit of an apparatus shown in FIG. 1, an electrochemical surface roughening treatment was continuously performed. At this time, the electrolytic solution used was an aqueous 1 wt % hydrochloric acid solution (containing 0.5 wt % of aluminum ion) and the liquid temperature was 35° C. The AC power source waveform used was a trapezoidal square waveform AC having a time tp necessary for the current value starting from 0 to reach the peak, of 1 msec, a duty ratio of 1:1 and a frequency of 60 Hz. Furthermore, carbon electrode was used for the counter electrode and ferrite was used for the auxiliary anode.

The current density in terms of a current peak value was 50 A/dm$^2$ and the electricity quantity in terms of a total electricity quantity when the aluminum plate was in an anode time, was 75 C/dm$^2$. The current flowing from the power source was divided by 5% into the auxiliary anode.

Thereafter, the aluminum plate was washed with water by spraying.

(8) Etching Treatment in Aqueous Alkali Solution

The aluminum plate was then etched by dipping it in an aqueous solution containing 27 wt % of NaOH and 6.5 wt % of aluminum ion at 40° C. to dissolve 0.3 g/m$^2$ of the aluminum plate. Thereafter, the aluminum plate was washed with water.

(9) Etching Treatment in Aqueous Alkali Solution

The aluminum plate was then etched by dipping it in an aqueous solution containing 26 wt % of NaOH and 6.5 wt % of aluminum ion at 45° C. to dissolve 0.5 g/m$^2$ of the aluminum plate. Thereafter, the aluminum plate was washed with water.

(10) Desmutting Treatment

The aluminum plate was then desmutted by dipping it in an aqueous 25 wt % sulfuric acid solution (containing 0.5 wt % of aluminum ion) at 60° C. for 5 seconds. Thereafter, the aluminum plate was washed with water.

(11) Anodization Treatment

The aluminum plate was then anodized in an aqueous solution having a sulfuric acid concentration of 100 g/l (containing 7 g/l of aluminum ion) at a liquid temperature of 55° C. using a DC voltage at a current density of 2 A/dm$^2$ to have an amount of anodic oxidation coating of 1.2 g/m$^2$. Thereafter, the aluminum plate was washed with water by spraying.

The surface of the thus-treated aluminum plate was free from occurrence of streaking ascribable to the orientation of crystal grains, and generation of plane quality unevenness.

On this aluminum plate, an interlayer and a photosensitive layer were coated and dried to prepare a positive PS plate for proof printing having a dry thickness of 2.0 g/m$^2$. Using this PS plate, printing was performed, as a result, this plate was verified to be a good printing plate having an excellent inking property.

Example 17

For the purpose of hydrophilization, the substrate after the anodization treatment in Example 16 was dipped in an aqueous solution containing 2.5 wt % of sodium silicate at 70° C. for 14 seconds. Thereafter, the substrate was washed with water by spraying and then dried. After each treatment and water washing, the solution was squeezed through nip rollers. On the thus-treated aluminum plate, an interlayer and a negative photosensitive layer were coated and dried to prepare a PS plate. Using this PS plate, printing was performed, as a result, this plate was verified to be a good printing plate.

Example 18

A JIS A 3103 aluminum plate having a thickness of 0.24 mm and a width of 1,030 mm was continuously treated as follows.

(1) Etching Treatment in Aqueous Alkali Solution

The aluminum plate was etched by dipping it in an aqueous solution containing 27 wt % of NaOH and 6.5 wt % of aluminum ion at 70° C. to dissolve 6 g/m$^2$ of the aluminum plate. Thereafter, the aluminum plate was washed with water.

(2) Desmutting Treatment

The aluminum plate was then desmutted by dipping it in an aqueous solution containing 1 wt % of hydrochloric acid at 35° C. for 5 seconds. Thereafter, the aluminum plate was washed with water.

(3) Electrochemical Surface Roughening Treatment in Aqueous Hydrochloric Acid Solution Using an AC voltage in FIG. 2 and one unit of an apparatus shown in FIG. 1, an electrochemical surface roughening treatment was continuously performed. At this time, the electrolytic solution used was an aqueous 1 wt % hydrochloric acid solution (containing 0.5 wt % of aluminum ion) and the liquid temperature was 35° C. The AC power source waveform used was a trapezoidal square waveform AC having a time tp necessary for the current value starting from 0 to reach the peak, of 1 msec, a duty ratio of 1:1 and a frequency of 60 Hz. Furthermore, carbon electrode was used for the counter electrode and ferrite was used for the auxiliary anode.

The current density in terms of a current peak value was 50 A/dm$^2$ and the electricity quantity in terms of a total electricity quantity when the aluminum plate was in an anode time, was 50 C/dm$^2$. The current flowing from the power source was divided by 5% into the auxiliary anode.

Thereafter, the aluminum plate was washed with water by spraying.

(4) Electrolytic Treatment in Aqueous Neutral Salt Solution Using Aluminum Plate as Cathode The aluminum plate was then electrolyzed using an aqueous sodium chloride solution in a concentration of 100 g/l at a liquid temperature of 70° C. for the auxiliary anode of (3) above.

For the electrode, ferrite was used. Thereafter, the aluminum plate was washed with water.

(5) Desmutting Treatment

The aluminum plate was then desmutted by dipping it in an aqueous solution containing 1 wt % of nitric acid at 35° C. for 5 seconds. Thereafter, the aluminum plate was washed with water.

(6) Electrochemical Surface Roughening Treatment in Aqueous Nitric Acid Solution Using an AC voltage shown in FIG. 2 and two units of an apparatus shown in FIG. 1, an electrochemical surface roughening treatment was continuously performed. At this time, the electrolytic solution used was an aqueous 1 wt % nitric acid solution (containing 0.5 wt % of aluminum ion and 0.007 wt % of ammonium ion) and the liquid temperature was 70° C. The AC power source waveform used was a trapezoidal square waveform AC having a time tp necessary for the current value starting from 0 to reach the peak, of 0.8 msec, a duty ratio of 1:1 and a frequency of 60 Hz. Furthermore, carbon electrode was used for the counter electrode and ferrite was used for the auxiliary anode. The current density in terms of a current peak value was 50 A/dm$^2$ and the electricity quantity in terms of a total electricity quantity when the aluminum plate was in an anode time, was 260 C/dm$^2$. The current flowing from the power source was divided by 5% into the auxiliary anode. Thereafter, the aluminum plate was washed with water by spraying.

(7) Etching Treatment in Aqueous Alkali Solution

The aluminum plate was then etched by dipping it in an aqueous solution containing 5 wt % of NaOH and 0.5 wt % of aluminum ion at 40° C. to dissolve 0.1 g/m$^2$ of the aluminum plate. Thereafter, the aluminum plate was washed with water. (8) Desmutting Treatment The aluminum plate was then desmutted by dipping it in an aqueous 25 wt % sulfuric acid solution (containing 0.5 wt % of aluminum ion) at 60° C. for 5 seconds. Thereafter, the aluminum plate was washed with water.

(9) Anodization Treatment

The aluminum plate was then anodized in an aqueous solution having a sulfuric acid concentration of 15 wt % (containing 0.5 wt % of aluminum ion) at a liquid temperature of 35° C. using a DC voltage at a current density of 2 A/dm$^2$ to have an amount of anodic oxidation coating of 2.4 g/m$^2$. Thereafter, the aluminum plate was washed with water by spraying.

The surface of the thus-treated aluminum plate was observed and it was found that uniform surface roughening was accomplished.

On the aluminum plate obtained, an interlayer and a photosensitive layer were coated and dried to prepare a positive PS plate having a dry thickness of 2.0 g/m$^2$. This PS plate was verified to be a good printing plate.

Example 19

For the purpose of hydrophilization, the substrate after the anodization treatment in Example 18 was dipped in an aqueous solution containing 2.5 wt % of sodium silicate at 70° C. for 14 seconds. Thereafter, the substrate was washed with water by spraying and then dried. After each treatment and water washing, the solution was squeezed through nip rollers. On the thus-treated aluminum plate, an interlayer and a negative photosensitive layer were coated and dried to prepare a PS plate. Using this PS plate, printing was performed, as a result, this plate was verified to be a good printing plate.

Example 20

The surface roughening treatment was performed thoroughly in the same manner as in Example 19 except for performing a buffing treatment before the chemical etching treatment in (1) of Example 18. The surface of the thus-treated aluminum plate was observed and it was found that uniform surface roughening was accomplished and treatment unevenness was not generated. On the thus-treated aluminum plate, an interlayer and a photosensitive layer were coated and dried to prepare a positive PS plate having a dry thickness of 2.0 g/m$^2$. This PS plate was verified to be a good printing plate.

Example 21

For the purpose of hydrophilization, the substrate after the anodization treatment in Example 20 was dipped in an aqueous solution containing 2.5 wt % of sodium silicate at 70° C. for 14 seconds. Thereafter, the substrate was washed with water by spraying and then dried. After each treatment and water washing, the solution was squeezed through nip rollers. On the thus-treated aluminum plate, an interlayer and a negative photosensitive layer were coated and dried to prepare a PS plate. Using this PS plate, printing was performed, as a result, this plate was verified to be a good printing plate.

Example 22

The surface roughening treatment was performed thoroughly in the same manner as in Example 13 except that a polishing treatment was performed before the anodization treatment in Example 13. For the polishing treatment, the apparatus shown in FIG. 3 was used. The polishing treatment was performed using 4 rollers each made of a close-texture nylon non-woven fabric and the rollers each had a diameter of 300 mm and rotated at 200 rpm.

The non-woven fabric rollers and the aluminum plate were sunk in water and the viscosity was adjusted to 17 CP by adding a polymer coagulant. In order to avoid attachment of dusts, the solution was passed through a filter before the use.

The lithographic printing plate obtained was used in a proofing machine. When an operator supplied a fountain solution with a sponge, hooking of the sponge did not occur, thus, this plate was verified to be a good printing plate of not easily allowing the generation of sponge debris. Furthermore, streaking and plane quality unevenness were not generated, therefore, the aluminum plate had no unevenness on the surface and exhibited good suitability for plate inspection.

Example 23

A JIS A 1050 aluminum plate having a thickness of 0.24 mm and a width of 1,030 mm was prepared by omitting intermediate annealing and soaking in a DC casting method to provide a state such that streaking or plane quality unevenness readily occurs at the chemical etching in an aqueous acid or alkali solution, and then continuously treated as follows.

(1) Mechanical Surface Roughening Treatment

The surface of the aluminum plate was mechanically roughened by means of a rotating roller nylon brush while feeding a suspension of quartz sand in water, having a specific gravity of 1.12 as an abrasive slurry solution to the surface of the aluminum plate. The nylon brush was formed of 6·10 nylon and had a bristle length of 50 mm and a bristle diameter of 0.295 mm. The nylon brush was obtained by densely fastening bristles to holes punched on a stainless steel-made cylinder of ϕ300 mm. Three rotating brushes were used and rotated to have an average surface roughness of 0.35 $\mu$m after the mechanical surface roughening.

(2) Etching Treatment in Aqueous Alkali Solution

The aluminum plate was etched by dipping it in an aqueous solution containing 27 wt % of NaOH and 6.5 wt % of aluminum ion at 70° C. to dissolve 8 g/m$^2$ of the aluminum plate. Thereafter, the aluminum plate was washed with water.

(3) Desmutting Treatment

The aluminum plate was then desmutted by dipping it in an aqueous solution containing 1 wt % of hydrochloric acid at 35° C. for 10 seconds. Thereafter, the aluminum plate was washed with water.

(4) Preliminary Electrochemical Surface Roughening Treatment in Aqueous Hydrochloric Acid Solution Using an AC voltage shown in FIG. 2 and one unit of an apparatus shown in FIG. 1, an electrochemical surface roughening treatment was continuously performed. At this time, the electrolytic solution used was an aqueous 1 wt % hydrochloric acid solution (containing 0.5 wt % of aluminum ion) and the liquid temperature was 35° C. The AC power source waveform used was a trapezoidal square waveform AC having a time TP necessary for the current value starting from 0 to reach the peak, of 0.5 msec, a duty ratio of 1:1 and a frequency of 60 Hz (Example 23-1), 120 Hz (Example 23-2) or 240 Hz (Example 23-3). Furthermore, carbon electrode was used for the counter electrode and ferrite was used for the auxiliary anode.

The current density in terms of a current peak value was 50 A/dm$^2$ and the electricity quantity in terms of a total electricity quantity when the aluminum plate was in an anode time, was 50 C/dm$^2$. The current flowing from the power source was divided by 5% into the auxiliary anode. Thereafter, the aluminum plate was washed with water by spraying.

(5) Electrochemical Surface Roughening Treatment in Aqueous Nitric Acid Solution Using an AC voltage shown in FIG. 2 and two units of an apparatus shown in FIG. 1, an electrochemical surface roughening treatment was continuously performed. At this time, the electrolytic solution used was an aqueous 1 wt % nitric acid solution (containing 0.5 wt % of aluminum ion and 0.007 wt % of ammonium ion) and the liquid temperature was 50° C. The AC power source waveform used was a trapezoidal square waveform AC having a time tp necessary for the current value starting from 0 to reach the peak, of 0.8 msec, a duty ratio of 1:1 and a frequency of 60 Hz. Furthermore, carbon electrode was used for the counter electrode and ferrite was used for the auxiliary anode.

The current density in terms of a current peak value was 50 A/dm$^2$ and the electricity quantity in terms of a total electricity quantity when the aluminum plate was in an anode time, was 210 C/dm$^2$. The current flowing from the power source was divided by 5% into the auxiliary anode. Thereafter, the aluminum plate was washed with water by spraying.

(6) Etching Treatment in Aqueous Alkali Solution

The aluminum plate was then etched by dipping it in an aqueous solution containing 26 wt % of NaOH and 6.5 wt % of aluminum ion at 45° C. to dissolve 1 g/m$^2$ of the aluminum plate. Thereafter, the aluminum plate was washed with water.

(7) Desmutting Treatment

The aluminum plate was then desmutted by dipping it in an aqueous solution containing 25 wt % of sulfuric acid at 60° C. Thereafter, the aluminum plate was washed with water.

(8) Anodization Treatment

The aluminum plate was then anodized in an aqueous solution having a sulfuric acid concentration of 10 wt % (containing 0.5 wt % of aluminum ion) at a liquid temperature of 50° C. using a DC voltage at a current density of 2 A/dm$^2$ to have an amount of anodic oxidation coating of 2.4 g/m$^2$. Thereafter, the aluminum plate was washed with water by spraying.

The surface of each aluminum plate thus treated was free from occurrence of streaking ascribable to the orientation of crystal grains, and generation of plane quality unevenness.

In particular, the supports of Examples 23-2 and 23-3 exhibited good suitability for plate inspection.

On each of the thus-obtained aluminum plate, an interlayer and a photosensitive layer were coated and dried to prepare a positive PS plate having a dry thickness of 2.0 g/m$^2$. Using each PS plate, printing was performed, as a result, these were verified to be a good printing plate.

Example 24

For the purpose of hydrophilization, the substrates after the anodization treatment in Examples 23-1, 23-2 and 23-3 each was dipped in an aqueous solution containing 2.5 wt % of sodium silicate at 70° C. for 14 seconds. Thereafter, each substrate was washed with water by spraying and then dried. After each treatment and water washing, the solution was squeezed through nip rollers.

On each of the thus-treated aluminum plates, an interlayer and a negative photosensitive layer were coated and dried to prepare a PS plate having a dry thickness of 2.0 g/m$^2$. Using each PS plate, printing was performed, as a result, these were verified to be a good printing plate.

Example 25

The surface roughening treatment was performed thoroughly in the same manner as in Example 23-1 except that the aluminum plate after the electrochemical surface roughening treatment in an aqueous solution mainly comprising a hydrochloric acid in (4) of Example 23-1 was dipped in an aqueous solution containing 25 wt % of sulfuric acid at 60° C. for 10 seconds to remove smut components mainly comprising aluminum hydroxide produced in the electrochemical surface roughening treatment and thereafter, the aluminum plate was washed with water. On the thus-treated aluminum plate, an interlayer and a photosensitive layer were coated and dried to prepare a positive PS plate having a dry thickness of 2.0 g/m$^2$. Using this PS plate, printing was performed, as a result, this plate were verified to be a good printing plate.

Example 26

The surface roughening treatment was performed thoroughly in the same manner as in Example 23-1 except that the aluminum plate after the electrochemical surface roughening treatment in an aqueous solution mainly comprising a hydrochloric acid in (4) of Example 23-1 was dipped in an aqueous solution containing 5 wt % of hydrochloric acid at 50° C. for 10 seconds to remove smut components mainly comprising aluminum hydroxide produced in the electrochemical surface roughening treatment and thereafter, the aluminum plate was washed with water. On the thus-treated aluminum plate, an interlayer and a photosensitive layer were coated and dried to prepare a positive PS plate having a dry thickness of 2.0 g/m$^2$. Using this PS plate, printing was performed, as a result, this plate were verified to be a good printing plate.

Example 27

The surface roughening treatment was performed in the same manner as in Example 23-2 except that in place of the chemical etching treatment in an aqueous alkali solution in (6) of Example 23-2, an electropolishing treatment was performed in an aqueous solution containing 9 wt % of caustic soda and 0.5 wt % of aluminum ion at 35° C. and a current density of 20 A/dm$^2$ using the aluminum plate as an anode to dissolve 1 g/m$^2$ of the aluminum plate. On the thus-treated aluminum plate, an interlayer and a negative photosensitive layer were coated and dried to prepare a PS plate. Using this PS plate, printing was performed, as a result, this plate was verified to be a good printing plate.

Example 28

Example 28-1

The surface roughening treatment was performed thoroughly in the same manner as in Example 23-3 except that the aluminum plate having attached thereon smuts mainly comprising aluminum hydroxide formed in the electrochemical surface roughening in an aqueous solution mainly comprising nitric acid in (5) of Example 23-2 was heat treated in air at a temperature of 200° C. for 90 minutes. The surface of the aluminum plate obtained was free of occurrence of streaking ascribable to the orientation of crystal grains and generation of plane quality unevenness. On the thus-treated aluminum plate, an interlayer and a positive photosensitive layer were coated and dried to prepared a PS plate. Using this PS plate, printing was performed, as a result, this plate was verified to be a good printing plate.

Example 28-2

The aluminum plate having attached thereon smuts mainly comprising aluminum hydroxide formed in the electrochemical surface roughening in an aqueous solution mainly comprising nitric acid in (5) of Example 23-3 was subjected to an induction heat treatment.

The induction heating time was 0.1 second. It is estimated that the temperature of the aluminum plate elevated up to 500° C. The surface of the thus-treated aluminum plate was free from occurrence of streaking ascribable to the orientation of crystal grains and generation of plane quality unevenness. On the thus-treated aluminum plate, an interlayer and a positive photosensitive layer were coated and dried to prepared a PS plate. Using this PS plate, printing was performed, as a result, this plate was verified to be a good printing plate.

Example 29

For the purpose of hydrophilization, the substrate after the anodization treatment in Example 28 was dipped in an aqueous solution containing 2.5 wt % of sodium silicate at 70° C. for 14 seconds. Thereafter, the substrate was washed with water by spraying and then dried. After each treatment and water washing, the solution was squeezed through nip rollers. On the thus-treated aluminum plate, an interlayer and a negative photosensitive layer were coated and dried to prepare a PS plate. Using this PS plate, printing was performed, as a result, this plate was verified to be a good printing plate.

Example 30

A JIS A 3103 aluminum plate having a thickness of 0.3 mm was continuously treated as follows.

(1) Etching Treatment in Aqueous Alkali Solution

The aluminum plate was etched by dipping it in an aqueous solution containing 27 wt % of NaOH and 6.5 wt % of aluminum ion at 70° C. to dissolve 6 g/m$^2$ of the aluminum plate. Thereafter, the aluminum plate was washed with water.

(2) Desmutting Treatment

The aluminum plate was then desmutted by dipping it in an aqueous solution containing 1 wt % of hydrochloric acid at 35° C. for 5 seconds. Thereafter, the aluminum plate was washed with water.

(3) Electrochemical Surface Roughening Treatment in Aqueous Hydrochloric Acid Solution Using an AC voltage shown in FIG. 2 and two units of an apparatus shown in FIG. 1, an electrochemical surface roughening treatment was continuously performed. At this time, the electrolytic solution used was an aqueous 1 wt % nitric acid solution (containing 0.5 wt % of aluminum ion and 0.007 wt % of ammonium ion) and the liquid temperature was 35° C. The AC power source waveform used was a trapezoidal square waveform AC having a time tp necessary for the current value starting from 0 to reach the peak, of 0.3 msec, a duty ratio of 1:1 and a frequency of 60 Hz (Example 30-1), 120 Hz (Example 30-2), 240 HZ (Example 30-3) or 480 Hz (Example 30-4). Furthermore, carbon electrode was used for the counter electrode and ferrite was used for the auxiliary anode. The current density in terms of a current peak value was 50 A/dm$^2$ and the electricity quantity in terms of a total electricity quantity when the aluminum plate was in an anode time, was 50 C/dm$^2$. The current flowing from the power source was divided by 5% into the auxiliary anode.

Thereafter, the aluminum plate was washed with water by spraying.

(4) Electrochemical Surface Roughening Treatment in Aqueous Nitric Acid Solution Using an AC voltage shown in FIG. 2 and two units of an apparatus shown in FIG. 1, an electrochemical surface roughening treatment was continuously performed. At this time, the electrolytic solution used was an aqueous 1 wt % nitric acid solution (containing 0.5 wt % of aluminum ion and 0.007 wt % of ammonium ion) and the liquid temperature was 50° C. The AC power source waveform used was a trapezoidal square waveform AC having a time tp necessary for the current value starting from 0 to reach the peak, of 0.8 msec, a duty ratio of 1:1 and a frequency of 60 Hz. Furthermore, carbon electrode was used for the counter electrode and ferrite was used for the auxiliary anode.

The current density in terms of a current peak value was 50 A/dm$^2$ and the electricity quantity in terms of a total electricity quantity when the aluminum plate was in an anode time, was 230 C/dm$^2$. The current flowing from the power source was divided by 5% into the auxiliary anode. Thereafter, the aluminum plate was washed with water by spraying.

(5) Etching Treatment in Aqueous Alkali Solution

The aluminum plate was then etched by dipping it in an aqueous solution containing 5 wt % of NaOH and 0.5 wt % of aluminum ion at 40° C. to dissolve 0.1 g/m$^2$ of the aluminum plate. Thereafter, the aluminum plate was washed with water.

(6) Desmutting Treatment

The aluminum plate was then desmutted by dipping it in an aqueous 25 wt % sulfuric acid solution (containing 0.5 wt % of aluminum ion) at 60° C. for 5 seconds. Thereafter, the aluminum plate was washed with water.

(7) Anodization Treatment

The aluminum plate was then anodized in an aqueous solution having a sulfuric acid concentration of 10 wt % (containing 0.5 wt % of aluminum ion) at a liquid temperature of 40° C. using a DC voltage at a current density of 2 A/dm$^2$ to have an amount of anodic oxidation coating of 2.4 g/m$^2$. Thereafter, the aluminum plate was washed with water by spraying.

The surface of each aluminum plate thus treated was free from occurrence of streaking ascribable to the orientation of crystal grains, and generation of plane quality unevenness.

On each of the thus-obtained aluminum plates, an interlayer and a photosensitive layer were coated and dried to prepare a positive PS plate having a dry thickness of 2.0 g/m$^2$. These PS plates were verified to be a good printing plate.

Example 31

For the purpose of hydrophilization, the substrate after the anodization treatment in Example 30-3 was dipped in an aqueous solution containing 2.5 wt % of sodium silicate at 70° C. for 14 seconds. Thereafter, the substrate was washed with water by spraying and then dried. After each treatment and water washing, the solution was squeezed through nip rollers. On the thus-treated aluminum plate, an interlayer and a negative photosensitive layer were coated and dried to prepare a PS plate. Using this PS plate, printing was performed, as a result, this plate was verified to be a good printing plate.

Example 32

The surface roughening treatment was performed in the same manner as in Example 30-1 except for performing a buffing treatment before the chemical etching treatment in (1) of Example 30-1. The surface of the thus-treated aluminum plate was almost free from occurrence of streaking ascribable to the orientation of crystal grains, and generation of plane quality unevenness. On the aluminum plate obtained, an interlayer and a photosensitive layer were coated and dried to prepare a positive PS plate having a dry thickness of 2.0 g/m$^2$. This PS plate was verified to be a good printing plate.

Example 33

For the purpose of hydrophilization, the substrate after the anodization treatment in Example 30-1 was dipped in an aqueous solution containing 0.2 wt % of polyvinylsulfonic acid at 60° C. for 20 seconds. Thereafter, the substrate was washed with water by spraying and then dried. After each treatment and water washing, the solution was squeezed through nip rollers. On the thus-treated aluminum plate, an interlayer and a negative photosensitive layer were coated and dried to prepare a PS plate. Using this PS plate, printing was performed, as a result, this plate was verified to be a good printing plate.

Example 34

The surface roughening treatment was performed thoroughly in the same manner as in Example 30-2 except that the quantity of electricity in (3) of Example 30-2 was changed to 25 C/dm$^2$ (Example 34-1), 100 C/dm$^2$ (Example 34-2) or 300 C/dm$^2$ (Example 34-3). The surface of the thus-treated aluminum plate was almost free from occurrence of streaking ascribable to the orientation of crystal grains, and generation of plane quality unevenness. On the aluminum plate obtained, an interlayer and a photosensitive layer were coated and dried to prepare a positive PS plate having a dry thickness of 2.0 g/m$^2$. This PS plate was verified to be a good printing plate.

Example 35

For the purpose of hydrophilization, the substrates after the anodization treatment in Examples 34-1, 34-2 and 34-3 each was dipped in an aqueous solution containing 2.5 wt % of sodium silicate at 70° C. for 14 seconds. Thereafter, each substrate was washed with water by spraying and then dried. After each treatment and water washing, the solution was squeezed through nip rollers. On each of the thus-treated aluminum plate, an interlayer and a negative photosensitive layer were coated and dried to prepare a PS plate. Using each PS plate, printing was performed, as a result, these were verified to be a good printing plate.

Example 36

For the purpose of hydrophilization, the substrate after the anodization treatment in Example 32 was dipped in an aqueous solution containing 2.5 wt % of sodium silicate at 70° C. for 14 seconds. Thereafter, the substrate was washed with water by spraying and then dried. After each treatment and water washing, the solution was squeezed through nip rollers. On the thus-treated aluminum plate, an interlayer and a negative photosensitive layer were coated and dried to prepare a PS plate. Using this PS plate, printing was performed, as a result, this plate was verified to be a good printing plate.

Example 37

The surface roughening treatment was performed in the same manner as in Example 23-1 except that the aluminum plate after the electrochemical surface roughening treatment in an aqueous solution mainly comprising a hydrochloric acid in (4) of Example 23-1 was dipped in an aqueous solution containing 25 wt % of sulfuric acid at 60° C. for 5 seconds to remove smut components mainly comprising aluminum hydroxide produced in the electrochemical surface roughening treatment and thereafter, the aluminum plate was washed with water. For the purpose of hydrophilization, the aluminum support after the anodization treatment was dipped in an aqueous solution containing 2.5 wt % of sodium silicate at 70° C. for 5 seconds. Thereafter, the aluminum support was washed with water by spraying and then dried. After each treatment and water washing, the solution was squeezed through nip rollers.

On the thus-treated aluminum plate, an interlayer and a negative photosensitive layer were coated and dried to prepare a PS plate. On the photosensitive layer, a matting layer was provided so as to attain good vacuum adhesion at the printing using a lith film. Using this PS plate, printing was performed, as a result, this plate were verified to be a good printing plate.

Example 38

The surface roughening treatment was performed in the same manner as in Example 23-1 except that the aluminum plate after the electrochemical surface roughening treatment in an aqueous solution mainly comprising a hydrochloric acid in (4) of Example 23-1 was dipped in an aqueous solution containing 25 wt % of sulfuric acid at 60° C. for 5 seconds to remove smut components mainly comprising aluminum hydroxide produced in the electrochemical surface roughening treatment and thereafter, the aluminum plate was washed with water. For the purpose of hydrophilization, the aluminum support after the anodization treatment was dipped in an aqueous solution containing 0.2 wt % of polyvinylphosphonic acid at 60° C. for 30 seconds. Thereafter, the aluminum support was washed with water by spraying and then dried. After each treatment and water washing, the solution was squeezed through nip rollers.

On the thus-treated aluminum plate, an interlayer and a negative photosensitive layer were coated and dried to prepare a PS plate. On the photosensitive layer, a matting layer was provided so as to attain good vacuum adhesion at the printing using a lithographic film. Using this PS plate, printing was performed, as a result, this plate were verified to be a good printing plate.

Example 39

The surface roughening treatment was performed in the same manner as in Example 23-1 except that the aluminum plate after the electrochemical surface roughening treatment in an aqueous solution mainly comprising a hydrochloric acid in (3) of Example 30 was dipped in an aqueous solution containing 25 wt % of sulfuric acid at 60° C. for 5 seconds to remove smut components mainly comprising aluminum hydroxide produced in the electrochemical surface roughening treatment and thereafter, the aluminum plate was washed with water. For the purpose of hydrophilization, the aluminum support after the anodization treatment was dipped in an aqueous solution containing 2.5 wt % of sodium silicate at 70° C. for 5 seconds. Thereafter, the aluminum support was washed with water by spraying and then dried. After each treatment and water washing, the solution was squeezed through nip rollers.

On the thus-treated aluminum plate, an interlayer and a negative photosensitive layer were coated and dried to prepare a PS plate. On the photosensitive layer, a matting layer was provided so as to attain good vacuum adhesion at the printing using a lith film. Using this PS plate, printing was performed, as a result, this plate were verified to be a good printing plate.

Example 40

The surface roughening treatment was performed in the same manner as in Example 23-1 except that the aluminum plate after the electrochemical surface roughening treatment in an aqueous solution mainly comprising a hydrochloric acid in (3) of Example 30 was dipped in an aqueous solution containing 25 wt % of sulfuric acid at 60° C. for 5 seconds to remove smut components mainly comprising aluminum hydroxide produced in the electrochemical surface roughening treatment and thereafter, the aluminum plate was washed with water. For the purpose of hydrophilization, the aluminum support after the anodization treatment was dipped in an aqueous solution containing 0.2 wt % of polyvinylphosphonic acid at 60° C. for 30 seconds. Thereafter, the aluminum support was washed with water by spraying and then dried. After each treatment and water washing, the solution was squeezed through nip rollers.

On the thus-treated aluminum plate, an interlayer and a negative photosensitive layer were coated and dried to prepare a PS plate. On the photosensitive layer, a matting layer was provided so as to attain good vacuum adhesion at the printing using a lith film. Using this PS plate, printing was performed, as a result, this plate were verified to be a good printing plate.

Comparative Example 2

The surface roughening treatment was performed in the same manner as in Example 23-1 except that the preliminary surface roughening treatment in an aqueous hydrochloric acid solution (4) was not performed in Example 23. The surface of this aluminum plate was observed and it was found that streaks were severely generated.

Example 41

A JIS A 1050 aluminum plate having a thickness of 0.24 mm and a width of 1,030 mm was prepared by omitting intermediate annealing and soaking in a DC casting method to provide a state such that streaking or plane quality unevenness readily occurs at the chemical etching in an aqueous acid or alkali solution, and then continuously treated as follows.

(1) Mechanical Surface Roughening Treatment

The surface of the aluminum plate was mechanically roughened by means of a rotating roller nylon brush while feeding a suspension of quartz sand in water, having a specific gravity of 1.12 as an abrasive slurry solution to the surface of the aluminum plate. The nylon brush was formed of 6·10 nylon and had a bristle length of 50 mm and a bristle diameter of 0.48 mm. The nylon brush was obtained by densely fastening bristles to holes punched on a stainless steel-made cylinder of ϕ300 mm. The mechanical surface roughening treatment was performed by alternately using a brush rotating in the forward direction and a roller rotating in the reverse direction to the proceeding direction of the aluminum plate. After the mechanical surface roughening treatment, the average surface roughness was 0.45 μm.

(2) Etching Treatment in Aqueous Alkali Solution

The aluminum plate was then etched by dipping it in an aqueous solution containing 27 wt % of NaOH and 6.5 wt % of aluminum ion at 75° C. to dissolve 8 g/m$^2$ of the aluminum plate. Thereafter, the aluminum plate was washed with water.

(3) Desmutting Treatment

The aluminum plate was then desmutted by dipping it in an aqueous solution containing 1 wt % of hydrochloric acid at 35° C. for 10 seconds. Thereafter, the aluminum plate was washed with water.

(4) Preliminary Electrochemical Surface Roughening Treatment in Aqueous Hydrochloric Acid Solution Using an AC voltage shown in FIG. 2 and one unit of an apparatus shown in FIG. 4, an electrochemical surface roughening treatment was continuously performed. At this time, the electrolytic solution used was an aqueous 1 wt % hydrochloric acid solution (containing 0.5 wt % of aluminum ion) and the liquid temperature was 35° C. The AC power source waveform used was a trapezoidal square waveform AC having a time tp necessary for the current value starting from 0 to reach the peak, of 0.3 msec, a duty ratio of 1:1 and a frequency of 60 Hz. Furthermore, carbon electrode was used for the counter electrode and ferrite was used for the auxiliary anode. The current density in terms of a current peak value was 50 A/dm$^2$ and the electricity quantity in terms of a total electricity quantity when the aluminum plate was in an anode time, was 50 C/dm$^2$. The current flowing from the power source was divided by 5% into the auxiliary anode. The time spent for passing the auxiliary electrolytic cell was 2.4 seconds.

The electrolytic solution fed to the electrolytic cell equipped with an auxiliary anode is shown in Table 1. In the auxiliary electrolytic cell, a desmutting treatment was performed while treating the aluminum plate by cathodic electrolysis. Thereafter, the aluminum plate was washed with water by spraying.

(5) Electrochemical Surface Roughening Treatment in Aqueous Nitric Acid Solution Using an AC voltage shown in FIG. 2 and two units of an apparatus shown in FIG. 1, an electrochemical surface roughening treatment was continuously performed. At this time, the electrolytic solution used was an aqueous 1 wt % nitric acid solution (containing 0.5 wt % of aluminum ion and 0.007 wt % of ammonium ion) and the liquid temperature was 50° C. The AC power source waveform used was a trapezoidal square waveform AC having a time tp necessary for the current value starting from 0 to reach the peak, of 1 msec, a duty ratio of 1:1 and a frequency of 60 Hz. Furthermore, carbon electrode was used for the counter electrode and ferrite was used for the auxiliary anode.

The current density in terms of a current peak value was 50 A/dm$^2$ and the electricity quantity in terms of a total electricity quantity when the aluminum plate was in an anode time, was 180 C/dm$^2$. The current flowing from the power source was divided by 5% into the auxiliary anode. Thereafter, the aluminum plate was washed with water by spraying.

(6) Etching Treatment in Aqueous Alkali Solution

The aluminum plate was then etched by dipping it in an aqueous solution containing 26 wt % of NaOH and 6.5 wt % of aluminum ion at 60° C. to dissolve 0.6 g/m$^2$ of the aluminum plate. Thereafter, the aluminum plate was washed with water.

(7) Desmutting Treatment

The aluminum plate was then desmutted by dipping it in an aqueous solution containing 10 wt % of sulfuric acid at 60° C. Thereafter, the aluminum plate was washed with water.

(8) Anodization Treatment

The aluminum plate was then anodized in an aqueous solution having a sulfuric acid concentration of 100 g/l (containing 5 g/l of aluminum ion) at a liquid temperature of 55° C. using a DC voltage while stepwise increasing the current density from 5 A/dm$^2$ to 35 A/dm$^2$ in about 5 A/dm$^2$ increments, to have an amount of anodic oxidation coating of 2.4 g/m$^2$. Thereafter, the aluminum plate was washed with water by spraying.

The surface of each aluminum plate thus treated was free from occurrence of streaking ascribable to the orientation of crystal grains, and generation of plane quality unevenness. On each of the thus-obtained aluminum plates, an interlayer and a photosensitive layer were coated and dried to prepare a positive PS plate having a dry thickness of 2.0 g/m$^2$. Using each PS plate, printing was performed, as a result, these were verified to be a good printing plate.

TABLE 1

| | Kind of Electrolytic Solution | Concentration of Electrolytic Solution (g/l) | Temperature of Electrolytic Solution (° C.) | Aluminum Ion Concentration in Electrolytic Solution (g/l) |
|---|---|---|---|---|
| Example 41- | sulfuric acid | 100 | 50 | 1 |
| - | ↓ | 350 | 60 | 1 |
| - | hydrochloride | 7.5 | 35 | 5 |
| - | ↓ | 7.5 | 50 | 5 |
| - | ↓ | 25 | 35 | 1 |
| - | ↓ | 25 | 50 | 1 |
| - | ↓ | 50 | 45 | 1 |
| - | ↓ | 50 | 45 | 1 |
| - | Nitric acid | 10 | 50 | 0.2 |
| -1 | ↓ | 300 | 60 | 0.2 |

Example 42

For the purpose of hydrophilization, the substrates after the anodization treatment of Examples 41-2, 41-3 and 41-7 shown in Table 1 each was dipped in an aqueous solution containing 2.5 wt % of sodium silicate at 70° C. for 14 seconds. Thereafter, each substrate was washed with water by spraying and then dried. After each treatment and water washing, the solution was squeezed through nip rollers.

On each of the thus-treated aluminum plates, an interlayer and a negative photosensitive layer were coated and dried to prepare a PS plate. Using each PS plate, printing was performed, as a result, these were verified to be a good printing plate.

Example 43

For the purpose of hydrophilization, the substrates after the anodization treatment of Examples 41-2, 41-3 and 41-7 shown in Table 1 each was dipped in an aqueous solution containing 0.2% of polyvinylphosphonic acid at 60° C. for 30 seconds. Thereafter, each substrate was washed with water by spraying and then dried. On each substrate, a photosensitive layer was coated to obtain a printing plate. Each printing plate was verified to be a good printing plate.

Example 44

The surface roughening treatment was performed thoroughly in the same manner as in Example 41 except that after the desmutting treatment while treating the aluminum plate by cathodic electrolysis in an aqueous solution mainly comprising hydrochloric acid in (4) of Example 41-3 was dipped in an aqueous solution containing 25 wt % of sulfuric acid at 60° C. for 10 seconds and thereafter, the aluminum plate was washed with water. On the thus-treated aluminum plate, an interlayer and a photosensitive layer were coated and dried to prepare a positive PS plate having a dry thickness of 2.0 g/m$^2$. Using this PS plate, printing was performed, as a result, this plate was verified to be a good printing plate.

Example 45

The surface roughening treatment was performed thoroughly in the same manner as in Example 41-2 except that in place of the chemical etching treatment in an aqueous alkali solution in (6) of Example 41-3, an electropolishing treatment was performed in an aqueous solution containing 9 wt % of caustic soda and 0.5 wt % of aluminum ion at 35° C. and a current density of 20 A/dm$^2$ using the aluminum plate as an anode to dissolve 1 g/m$^2$ of the aluminum plate. On the thus-treated aluminum plate, an interlayer and a negative photosensitive layer were coated and dried to prepare a PS plate. Using this PS plate, printing was performed, as a result, this plate was verified to be a good printing plate.

Example 46

The surface treatment was performed thoroughly in the same manner as in Example 41 except that the aluminum plate having attached thereon smuts mainly comprising aluminum hydroxide formed at the electrochemical surface roughening treatment in (5) of Example 41-3 was heat treated in air at a temperature of 200° C. for 90 minutes. On the thus-treated aluminum plate, an interlayer and a positive photosensitive layer were coated and dried to prepare a PS plate. Using this PS plate, printing was performed, as a result, this plate was verified to be a good printing plate.

Example 47

Figure 3:
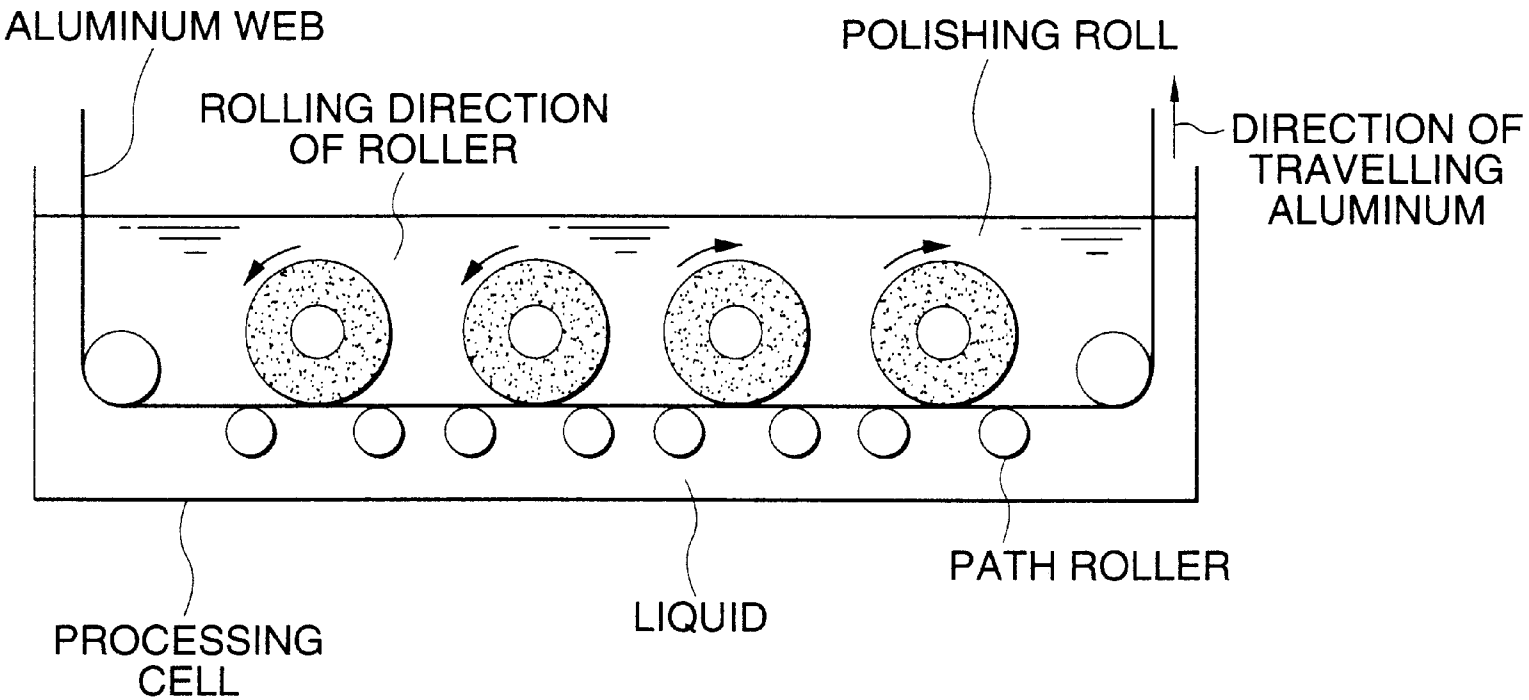
FIG. 3 is a schematic view showing one example of the apparatus for use in the polishing treatment of the present invention.

The substrate before the anodization in Example 41-3 was polished using an apparatus shown in FIG. 3 in an aqueous solution adjusted to have a viscosity of 17 cp by adding a polymer coagulant. On the thus-treated aluminum plate, an interlayer and a photosensitive layer were coated and dried to prepare a positive PS plate having a dry thickness of 1.2 g/m$^2$. Using the PS plate obtained, printing was performed, as a result, this plate was verified to be a good printing plate. Furthermore, hooking of a sponge used for supplying a fountain solution scarcely occurred on this printing plate, thus, this was also verified to be a good printing plate for proof printing.

Example 48

The surface roughening treatment was performed thoroughly in the same manner as in Example 41-3 except for performing a buffing treatment before the mechanical surface roughening treatment in (1) of Example 41-3. The surface of the thus-treated aluminum plate was almost free from occurrence of streaking ascribable to the orientation of crystal grains, and generation of plane quality unevenness.

On the aluminum plate obtained, an interlayer and a photosensitive layer were coated and dried to prepare a positive PS plate having a dry thickness of 2.0 g/m$^2$. This PS plate was verified to be a good printing plate.

Example 49

The conditions of the aqueous sulfuric acid solution used in the anodization treatment in (8) of Example 41-3 were changed as shown in Table 2. The amount of the anodic oxidation coating was adjusted by varying the current density.

The aluminum plates obtained were free of generation of burning due to the concentration of current in the anodization step.

TABLE 2

| | Concentration of Sulfuric Acid (g/l) | Aluminum Ion Concentration (g/l) | Liquid Temperature (° C.) | Amount of Anodic Oxidation Coating ($g/m^2$) |
|---|---|---|---|---|
| Example 49-1 | 100 | 7 | 55 | 2.4 |
| -2 | 115 | 5 | 55 | 2.4 |
| -3 | 90 | 3 | 55 | 2.4 |
| -4 | 100 | 5 | 50 | 2.4 |
| -5 | 150 | 5 | 35 | 1.8 |
| -6 | 150 | 5 | 30 | 1.8 |
| -7 | 150 | 5 | 37 | 1.8 |
| -8 | 170 | 5 | 35 | 1.8 |
| -9 | 130 | 5 | 35 | 1.8 |

Example 50

A JIS 3103 aluminum plate having a thickness of 0.3 mm was continuously treated as follows.

(1) Etching Treatment in Aqueous Alkali Solution

The aluminum plate was etched by dipping it in an aqueous solution containing 27 wt % of NaOH and 6.5 wt % of aluminum ion at 70° C. to dissolve 6 $g/m^2$ of the aluminum plate. Thereafter, the aluminum plate was washed with water.

(2) Desmutting Treatment

The aluminum plate was then desmutted by dipping it in an aqueous solution containing 1 wt % of hydrochloric acid at 35° C. for 5 seconds. Thereafter, the aluminum plate was washed with water.

(3) Electrochemical Surface Roughening Treatment in Aqueous Hydrochloric Acid Solution Using an AC voltage shown in FIG. 2 and one unit of an apparatus shown in FIG. 4, an electrochemical surface roughening treatment was continuously performed. At this time, the electrolytic solution used was an aqueous 1 wt % hydrochloric acid solution (containing 0.5 wt % of aluminum ion) and the liquid temperature was 35° C. The AC power source waveform used was a trapezoidal square waveform AC having a time TP necessary for the current value starting from 0 to reach the peak, of 0.3 msec, a duty ration of 1:1 and a frequency of 60 Hz (Example 50-1), 120 Hz (Example 50-2) or 240 Hz (Example 50-3). Furthermore, carbon electrode was used for the counter electrode and ferrite was used for the auxiliary anode.

The current density in terms of a current peak value was 50 $A/dm^2$ and the electricity quantity in terms of a total electricity quantity when the aluminum plate was in an anode time, was 50 $C/dm^2$. The current flowing from the power source was divided by 5% into the auxiliary anode. The time spent for passing the auxiliary electrolytic cell was 2.4 seconds.

The electrolytic solution fed to the electrolytic cell equipped with an auxiliary anode was an aqueous solution having a hydrochloric acid concentration of 50 g/l and an aluminum ion concentration of 4 g/l at a liquid temperature of 40° C. In the auxiliary electrolytic cell, a desmutting treatment was performed while treating the aluminum plate by cathodic electrolysis. Thereafter, the aluminum plate was washed with water by spraying.

(4) Electrochemical Surface Roughening Treatment in Aqueous Nitric Acid Solution Using an AC voltage shown in FIG. 2 and two units of an apparatus shown in FIG. 1, an electrochemical surface roughening treatment was continuously performed. At this time, the electrolytic solution used was an aqueous 1 wt % nitric acid solution (containing 0.5 wt % of aluminum ion and 0.007 wt % of ammonium ion) and the liquid temperature was 50° C. The AC power source waveform used was a trapezoidal square waveform AC having a time tp necessary for the current value starting from 0 to reach the peak, of 0.8 msec, a duty ratio of 1:1 and a frequency of 60 Hz. Furthermore, carbon electrode was used for the counter electrode and ferrite was used for the auxiliary anode.

The current density in terms of a current peak value was 50 $A/dm^2$ and the electricity quantity in terms of a total electricity quantity when the aluminum plate was in an anode time, was 230 $C/dm^2$. The current flowing from the power source was divided by 5% into the auxiliary anode. Thereafter, the aluminum plate was washed with water by spraying.

(5) Etching Treatment in Aqueous Alkali Solution

The aluminum plate was then etched by dipping it in an aqueous solution containing 5 wt % of NaOH and 0.5 wt % of aluminum ion at 40° C. to dissolve 0.1 $g/m^2$ of the aluminum plate. Thereafter, the aluminum plate was washed with water.

(6) Desmutting Treatment

The aluminum plate was then desmutted by dipping it in an aqueous 25 wt % sulfuric acid solution (containing 0.5 wt % of aluminum ion) at 60° C. for 5 seconds. Thereafter, the aluminum plate was washed with water.

(7) Anodization Treatment

The aluminum plate was then anodized in an aqueous solution having a sulfuric acid concentration of 150 g/l (containing 5 g/l of aluminum ion) at a liquid temperature of 35° C. using a DC voltage at a current density of 2 $A/dm^2$ to have an amount of anodic oxidation coating of 2.4 $g/m^2$. Thereafter, the aluminum plate was washed with water by spraying.

The thus-treated aluminum plates each had good plane quality.

On each of the aluminum plates obtained, an interlayer and a photosensitive layer were coated and dried to prepare a positive PS plate having a dry thickness of 2.0 $g/m^2$. These PS plates were verified to be a good printing plate.

Example 51

For the purpose of hydrophilization, the substrate after the anodization treatment in Example 50-1 was dipped in an aqueous solution containing 2.5 wt % of sodium silicate at 70° C. for 14 seconds. Thereafter, the substrate was washed with water by spraying and then dried. After each treatment and water washing, the solution was squeezed through nip rollers. On the thus-treated aluminum plate, an interlayer and a negative photosensitive layer were coated and dried to prepare a PS plate. Using this PS plate, printing was performed, as a result, this plate was verified to be a good printing plate.

Example 52

The surface roughening treatment was performed thoroughly in the same manner as in Example 50-1 except for performing a buffing treatment before the chemical etching treatment in (1) of Example 50-1. The thus-treated aluminum plate had good plane quality. On the aluminum plate obtained, an interlayer and a photosensitive layer were coated and dried to prepare a positive PS plate having a dry thickness of 2.0 $g/m^2$. This PS plate was verified to be a good printing plate.

Example 53

The surface roughening treatment was performed thoroughly in the same manner as in Example 50-3 except that the quantity of electricity in the preliminary electrochemical surface roughening treatment in an aqueous hydrochloric acid solution in (3) of Example 50-3 was changed to, in terms of a total electricity when the aluminum plate was in an anode time, 25 C/dm$^2$ (Example 53-1), 100 C/dm$^2$ (Example 53-2) or 300 C/dm$^2$ (Example 53-3). The thus-treated aluminum plates each had good plane quality. On each of the aluminum plates obtained, an interlayer and a photosensitive layer were coated and dried to prepare a positive PS plate having a dry thickness of 2.0 g/m$^2$. These PS plates were verified to be a good printing plate.

Example 54

For the purpose of hydrophilization, the substrate after the anodization treatment of Example 50-1 was dipped in an aqueous solution containing 0.2% of polyvinylphosphonic acid at 60° C. for 30 seconds. Thereafter, each substrate was washed with water by spraying and then dried. On the substrate obtained, a photosensitive layer was coated to obtain a printing plate. This was verified to be a good printing plate.

While the invention has been described in detail and with reference to specific embodiments thereof, it will be apparent to one skilled in the art that various changes and modifications can be made therein without departing from the spirit and scope thereof.

This application is based on Japanese Patent Applications No. 11-115112 filed on Apr. 22, 1999, No. 11-120452 filed on Apr. 27, 1999, No. 11-178624 filed on Jun. 24, 1999, and No. 11-178625 filed on Jun. 24, 1999, the entire contents of which are incorporated herein by reference.

What is claimed is:

1. A method for producing an aluminum support for lithographic printing plates, comprising subjecting an aluminum plate in sequence to (1) a surface roughening treatment, (2) a heat treatment, (3) a treatment of dissolving from 0.01 to 5 g/m$^2$ of said aluminum plate, and then (4) an anodization treatment.

2. The method for producing an aluminum support for lithographic printing plates as claimed in claim 1, wherein the surface roughening treatment is performed by combining one or more of a mechanical surface roughening treatment, a buffing treatment, a polishing treatment, a chemical etching treatment in an aqueous acid or alkali solution, an electropolishing treatment in an aqueous acid or alkali solution using the aluminum plate as an anode, an electrolytic treatment in an aqueous neutral salt solution using the aluminum plate as an anode or a cathode, or an electrochemical surface roughening treatment in an acidic aqueous solution using DC or AC.

3. The method for producing an aluminum support for lithographic printing plates as claimed in claim 2, wherein after the etching of the aluminum plate with an aqueous alkali solution, after the electropolishing treatment in an aqueous alkali solution or after the electrolytic treatment in an aqueous neutral salt solution using the aluminum plate as a cathode, the aluminum plate is desmutted in an acidic aqueous solution.

4. The method for producing an aluminum support for lithographic printing plates as claimed in claim 1, wherein the heat treatment is performed to ratse the aluminum plate to from 70 to 700° C.

5. The method for producing an aluminum support for lithographic printing plates as claimed in claim 1, wherein before the anodization treatment, a hydrophilization treatment is performed.

6. The method for producing an aluminum support for lithographic printing plates as claimed in claim 1, wherein after the anodization treatment, a hydrophilization treatment is performed.

7. A method for producing an aluminum support for lithographic printing plates, comprising subjecting an aluminum plate in sequence to (1) a chemical etching treatment, (2) an electrochemical surface roughening treatment in an acidic aqueous solution, (3) a heat treatment, (4) a treatment of etching from 0.01 to 5 g/m$^2$ of said aluminum plate, and then (5) an anodization treatment.

8. The method for producing an aluminum support for lithographic printing plates as claimed in claim 7, wherein the treatment of etching from 0.01 to 5 g/m$^2$ of the aluminum plate is a chemical etching treatment in an aqueous acid or alkali solution, an electropolishing treatment in an aqueous acid or alkali solution using the aluminum plate as an anode or an electrolytic treatment in an aqueous neutral salt solution using the aluminum plate as a cathode.

9. The method for producing an aluminum support for lithographic printing plates as claimed in claim 7, wherein before the first-step chemical etching treatment, a mechanical surface roughening treatment, a buffing treatment, or both a buffing treatment and a mechanical surface roughening treatment is performed.

10. A method for producing an aluminum support for lithographic printing plates, comprising subjecting an aluminum plate in sequence to (1) a chemical etching treatment, (2) a preliminary electrochemical surface roughening treatment in an aqueous hydrochloric acid solution with an electricity quantity of from 1 to 300 C/dm$^2$, (3) a treatment of etching from 0.01 to 3 g/m$^2$ of said aluminum plate, (4) an electrochemical surface roughening treatment in an acidic aqueous solution, (5) a heat treatment, (6) a treatment of etching from 0.01 to 5 g/m$^2$ of said aluminum plate, and then (7) an anodization treatment.

11. A method for producing an aluminum support for lithographic printing plates, comprising subjecting an aluminum plate in sequence to (1) a chemical etching treatment, (2) an electrochemical surface roughening treatment in an acidic aqueous solution, (3) a treatment of etching from 0.01 to 5 g/m$^2$ of said aluminum plate, (4) an electrochemical surface roughening treatment in an aqueous hydrochloric acid solution with an electricity quantity of from 1 to 300 C/dm$^2$, (5) a heat treatment, (6) a treatment of etching from 0.01 to 3 g/m$^2$ of said aluminum plate, and then (7) an anodization treatment.

12. A method for producing an aluminum support for lithographic printing plates, comprising subjecting an aluminum plate in sequence to (1) an electrochemical surface roughening treatment both before and after an electrolytic treatment in an aqueous neutral salt solution using the aluminum plate as a cathode, (2) a heat treatment, (3) a treatment of dissolving from 0.01 to 5 $g/m^2$ of said aluminum plate, and then (4) an anodization treatment.

13. A method for producing an aluminum support for lithographic printing plates, comprising subjecting an aluminum plate in sequence to (1) an etching treatment and/or a desmutting treatment in an acidic aqueous solution, (2) a preliminary electrochemical surface roughening treatment in an aqueous hydrochloric acid solution with an electricity quantity of from 1 to 300 $C/dm^2$ using AC of from 50 to 500 Hz, (3) an electrochemical surface roughening treatment in an acidic aqueous solution, (4) a heat treatment, (5) a treatment of etching of from 0.01 to 5 $g/m^2$ of said aluminum plate, and then (6) an anodization treatment.

14. A method for producing an aluminum support for lithographic printing plates, comprising subjecting an aluminum plate in sequence to (1) an etching treatment and/or a desmutting treatment in an acidic aqueous solution, (2) a preliminary electrochemical surface roughening treatment in an aqueous hydrochloric acid solution with an electricity quantity of from 1 to 300 $C/dm^2$ using AC of from 50 to 500 Hz, (3) a treatment of etching from 0.01 to 5 $g/m^2$ of said aluminum plate and/or desmutting treatment in an acidic aqueous solution, (4) an electrochemical surface roughening treatment in an acidic aqueous solution, (5) a heat treatment, (6) a treatment of etching from 0.01 to 5 $g/m^2$ of said aluminum plate, and then (7) an anodization treatment.

* * * * *